US009010743B2

(12) United States Patent
Miyake et al.

(10) Patent No.: US 9,010,743 B2
(45) Date of Patent: Apr. 21, 2015

(54) SHEET STACKING APPARATUS

(71) Applicant: Canon Kabushiki Kaisha, Tokyo (JP)

(72) Inventors: Toshiyuki Miyake, Abiko (JP); Mitsuhiko Sato, Kashiwa (JP); Shunsuke Nishimura, Tokyo (JP); Takashi Yokoya, Kashiwa (JP); Hiromasa Maenishi, Matsudo (JP); Yutaka Ando, Toride (JP); Nozomi Kumakura, Abiko (JP); Akihiro Arai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/218,654

(22) Filed: Mar. 18, 2014

(65) Prior Publication Data

US 2014/0197590 A1 Jul. 17, 2014

Related U.S. Application Data

(63) Continuation of application No. 13/565,587, filed on Aug. 2, 2012, now Pat. No. 8,714,538.

(30) Foreign Application Priority Data

Aug. 5, 2011 (JP) ..... 2011-171997

(51) Int. Cl.

| | |
|---|---|
| ***B65H 37/04*** | (2006.01) |
| ***B42C 1/00*** | (2006.01) |
| ***B65H 31/34*** | (2006.01) |
| ***B65H 39/10*** | (2006.01) |
| ***B65H 39/00*** | (2006.01) |

(52) U.S. Cl.

CPC *B42C 1/00* (2013.01); *B65H 31/34* (2013.01); *B65H 39/10* (2013.01); *B65H 2301/33312* (2013.01); *B65H 2301/4213* (2013.01); *B65H 2511/414* (2013.01); *B65H 2515/10* (2013.01); *B65H 2701/1313* (2013.01); *B65H 2801/06* (2013.01); *B65H 39/00* (2013.01)

(58) Field of Classification Search

USPC ..... 270/58.07, 58.08, 58.09, 58.11, 58.16, 270/58.17; 399/410

See application file for complete search history.

(56) References Cited

U.S. PATENT DOCUMENTS

| | | | | |
|---|---|---|---|---|
| 8,511,665 | B2 * | 8/2013 | Iwata et al. | 270/58.31 |
| 8,714,538 | B2 * | 5/2014 | Miyake et al. | 270/58.09 |
| 2003/0184010 | A1 * | 10/2003 | Kato et al. | 271/207 |
| 2007/0045925 | A1 * | 3/2007 | Moriyama et al. | 270/58.07 |

(Continued)

FOREIGN PATENT DOCUMENTS

| | | | |
|---|---|---|---|
| CN | 1690873 | A | 11/2005 |
| CN | 101311089 | A | 11/2008 |

(Continued)

*Primary Examiner* — Patrick Mackey

(74) *Attorney, Agent, or Firm* — Canon USA Inc IP Division

(57) ABSTRACT

When information about weight of a sheet indicates weight less than a predetermined weight, a sheet stacking apparatus configured to align sheets to be stacked on a stacking tray discharges the sheet onto the stacking tray while overlapping the sheet with another sheet by an overlapping unit, and, when the information about the weight of the sheet indicates weight not less than the predetermined weight, the sheet stacking apparatus discharges the sheet onto the stacking tray without overlapping the sheet with another sheet by the overlapping unit.

15 Claims, 18 Drawing Sheets

(56) References Cited

U.S. PATENT DOCUMENTS

| | | | | |
|---|---|---|---|---|
| 2008/0067730 | A1 | 3/2008 | Suzuki | |
| 2010/0225042 | A1* | 9/2010 | Tanaka et al. | 270/58.07 |
| 2011/0285072 | A1* | 11/2011 | Yokoya et al. | 270/58.07 |
| 2012/0049437 | A1* | 3/2012 | Matsumoto et al. | 271/11 |
| 2012/0175835 | A1* | 7/2012 | Saitsu | 270/58.07 |
| 2013/0026696 | A1* | 1/2013 | Matsumoto et al. | 271/5 |
| 2013/0032988 | A1* | 2/2013 | Miyake et al. | 270/58.08 |
| 2013/0147106 | A1* | 6/2013 | Tamura | 270/58.07 |

FOREIGN PATENT DOCUMENTS

| | | | |
|---|---|---|---|
| JP | 2013001487 | A * | 1/2013 |
| JP | 2013139335 | A * | 7/2013 |

* cited by examiner

FRONT SIDE VIEW

VIEW AS SEEN FROM SHEET DISCHARGE SIDE

ALIGNMENT POSITION

RETRACTED POSITION 500
511
512
513
514
515
516
517
518
519
521
522
523
540
541
570
571
572
573
574
575
576
580
601
630
641
660
661
680
680a
700
701
710
711
P

STANDBY POSITION
(FRONT SIDE)
TRAY CENTRAL POSITION

ALIGNMENT POSITION
(FRONT SIDE)

STANDBY POSITION
(FRONT SIDE)

ALIGNMENT
COMPLETION POSITION
(FRONT SIDE)

RETRACTED POSITION
(FRONT SIDE)

RETRACTED POSITION
(BACK SIDE)

STANDBY POSITION
(BACK SIDE)

SHEET DISCHARGE
(BACK SIDE)

ALIGNMENT POSITION
(BACK SIDE)

STANDBY POSITION
(BACK SIDE)

FINISHING SELECTION SCREEN

FINISHING SELECTION SCREEN

STAPLE POSITION SELECTION SCREEN (CORNER STITCHING)

FIG.16

| | PATTERNS OF SHEETS RECEIVED FROM IMAGE FORMING APPARATUS 10 | PATTERNS SHEETS DISCHARGED TO STACKING TRAY 701 |
|---|---|---|
| PATTERN NUMBER | (FIRST SHEET) NUMBER OF COPIES - SHEETS SIZE POST-PROCESSING GRAMMAGE<br>(SECOND SHEET) NUMBER OF COPIES - SHEETS SIZE POST-PROCESSING GRAMMAGE | (FIRST SHEET) NUMBER OF COPIES - SHEETS SIZE POST-PROCESSING GRAMMAGE<br>(SECOND SHEET) NUMBER OF COPIES - SHEETS SIZE POST-PROCESSING GRAMMAGE |
| 1 | 1-1 A4 SHIFT SORT 80 gsm<br>1-2 A4 SHIFT SORT 80 gsm<br>1-3 A4 SHIFT SORT 80 gsm<br>1-4 A4 SHIFT SORT 80 gsm | 1-1 A4 SHIFT SORT 80 gsm<br>1-2 A4 SHIFT SORT 80 gsm<br>1-3 A4 SHIFT SORT 80 gsm<br>1-4 A4 SHIFT SORT 80 gsm<br>NO BUFFERING |
| 2 | 1-1 A4 SHIFT SORT 52 gsm<br>1-2 A4 SHIFT SORT 52 gsm<br>1-3 A4 SHIFT SORT 52 gsm<br>1-4 A4 SHIFT SORT 52 gsm | 1-1 A4 SHIFT SORT 52 gsm<br>1-2 A4 SHIFT SORT 52 gsm<br>1-3 A4 SHIFT SORT 52 gsm<br>1-4 A4 SHIFT SORT 52 gsm<br>BUFFERING IN TWO SHEETS |
| 3 | 1-1 A4 SHIFT SORT 52 gsm<br>1-2 A4 SHIFT SORT 52 gsm<br>1-3 A4 SHIFT SORT 52 gsm | 1-1 A4 SHIFT SORT 52 gsm<br>1-2 A4 SHIFT SORT 52 gsm<br>1-3 A4 SHIFT SORT 52 gsm<br>BUFFERING IN THREE SHEETS |
| 4 | 1-1 A4 STAPLE 80 gsm<br>1-2 A4 STAPLE 80 gsm<br>1-3 A4 STAPLE 80 gsm<br>1-4 A4 STAPLE 80 gsm | 1-1 A4 STAPLE 80 gsm<br>1-2 A4 STAPLE 80 gsm<br>1-3 A4 STAPLE 80 gsm<br>1-4 A4 STAPLE 80 gsm<br>BUFFERING ON THIRD SHEET FROM LEADING SHEET OF BUNDLE |
| 5 | 1-1 A4 STAPLE 300 gsm<br>1-2 A4 STAPLE 300 gsm<br>1-3 A4 STAPLE 300 gsm<br>1-4 A4 STAPLE 300 gsm | 1-1 A4 STAPLE 300 gsm<br>1-2 A4 STAPLE 300 gsm<br>1-3 A4 STAPLE 300 gsm<br>1-4 A4 STAPLE 300 gsm<br>NO BUFFERING |

FIG.17

| | PATTERNS OF SHEETS RECEIVED FROM IMAGE FORMING APPARATUS 10 | PATTERNS SHEETS DISCHARGED TO STACKING TRAY 701 |
|---|---|---|
| PATTERN NUMBER | (FIRST SHEET) NUMBER OF COPIES · SHEETS SIZE POST-PROCESSING GRAMMAGE<br>(SECOND SHEET) NUMBER OF COPIES · SHEETS SIZE POST-PROCESSING GRAMMAGE | (FIRST SHEET) NUMBER OF COPIES · SHEETS SIZE POST-PROCESSING GRAMMAGE<br>(SECOND SHEET) NUMBER OF COPIES · SHEETS SIZE POST-PROCESSING GRAMMAGE |
| 6 | 1-1 A4 SHIFT SORT 52 gsm<br>1-2 A4 SHIFT SORT 80 gsm<br>1-3 A4 SHIFT SORT 80 gsm<br>1-4 A4 SHIFT SORT 80 gsm | 1-1 A4 SHIFT SORT 52 gsm<br>1-2 A4 SHIFT SORT 80 gsm<br>1-3 A4 SHIFT SORT 80 gsm<br>1-4 A4 SHIFT SORT 80 gsm<br>BUFFERING WITH SUBSEQUENT PLAIN PAPER |
| 7 | 1-1 A4 SHIFT SORT 80 gsm<br>1-2 A4 SHIFT SORT 52 gsm<br>1-3 A4 SHIFT SORT 52 gsm<br>1-4 A4 SHIFT SORT 80 gsm | 1-1 A4 SHIFT SORT 80 gsm<br>1-2 A4 SHIFT SORT 52 gsm<br>1-3 A4 SHIFT SORT 52 gsm<br>1-4 A4 SHIFT SORT 80 gsm<br>BUFFERING WITH SUBSEQUENT THIN PAPER |
| 8 | 1-1 A4 SHIFT SORT 80 gsm<br>1-2 A4 SHIFT SORT 52 gsm<br>1-3 A4 SHIFT SORT 80 gsm<br>1-4 A4 SHIFT SORT 80 gsm | 1-1 A4 SHIFT SORT 80 gsm<br>1-2 A4 SHIFT SORT 52 gsm<br>1-3 A4 SHIFT SORT 80 gsm<br>1-4 A4 SHIFT SORT 80 gsm<br>BUFFERING WITH SUBSEQUENT PLAIN PAPER |
| 9 | 1-1 A4 SHIFT SORT 80 gsm<br>1-2 A4 SHIFT SORT 80 gsm<br>1-3 A4 SHIFT SORT 52 gsm | 1-1 A4 SHIFT SORT 80 gsm<br>1-2 A4 SHIFT SORT 80 gsm<br>1-3 A4 SHIFT SORT 52 gsm<br>BUFFERING WITH PRECEDING PLAIN PAPER |

SHEET STACKING APPARATUS

CROSS REFERENCE TO RELATED APPLICATIONS

The present application is a continuation of U.S. patent application Ser. No. 13/565,587, filed on Aug. 2, 2012, the content of which is expressly incorporated by reference herein in its entirety. This application also claims the benefit of Japanese Patent Application No. 2011-171997 filed Aug. 5, 2011, which is hereby incorporated by reference herein in its entirety.

BACKGROUND OF THE INVENTION

1. Field of the Invention

The present disclosure relates to a sheet stacking apparatus having the function of aligning sheets stacked on a stacking tray.

2. Description of the Related Art

Conventionally, there has been provided a system in which a sheet post-processing apparatus (finisher) is connected to the downstream side with respect to the sheet conveyance direction of an image forming apparatus, such as a copying machine, making it possible to perform post-processing, such as staple processing or punching processing.

In the finisher, sheets received from the image forming apparatus are successively stacked on an intermediate tray (hereinafter referred to as the processing tray) provided on the upstream side of the stacking tray. There has been discussed a finisher which performs post-processing, such as stapling and saddle binding, on the sheets stacked on the processing tray after the stacking of all the sheets constituting a booklet has been completed. The sheet bundle on which post-processing has been completed on the processing tray is discharged from the processing tray onto the stacking tray.

Japanese Patent Application Laid-Open No. 2001-240295 discusses a finisher in which sheets received from an image forming apparatus are discharged onto a stacking tray without being passed by way of the above-described processing tray, and then performs alignment processing in a width direction that is orthogonal to the discharge direction by alignment members provided on the stacking tray.

In an apparatus in which sheet alignment is performed on a stacking tray as in the case of the apparatus discussed in Japanese Patent Application Laid-Open No. 2001-240295, an alignment operation by an alignment member is performed each time a sheet is discharged. However, in the case of a thin paper sheet (e.g., a sheet whose grammage is less than 64 g), the following phenomenon may occur when the sheet is discharged to the exterior via a discharge outlet of the finisher due to the lack of strength (stiffness) in the conveyance direction and to the lightness of the sheet. More specifically, as compared with the case of a sheet of larger grammage, the thin paper may cause deviation in alignment timing due to the slowness in the falling of the sheet and leaning of the sheet on the discharge outlet, resulting in deterioration in stacking property.

The alignment property can be improved by delaying the alignment timing in synchronization with the falling of the thin sheet from the discharge outlet. However, when the alignment timing is delayed, it will be necessary to enlarge the sheet interval between the sheet being aligned and the next sheet to be received from the image forming apparatus, resulting in deterioration in productivity.

SUMMARY OF THE INVENTION

The present disclosure is directed to a sheet stacking apparatus in which the above described issues have been eliminated. Further, the present disclosure is directed to a sheet stacking apparatus that can discharge a plurality of relatively lightweight sheets collectively to perform an alignment operation thereon and maintain satisfactory stacking property and alignment property regardless of a sheet weight.

According to an aspect disclosed herein, a sheet stacking apparatus includes an acquisition unit configured to acquire information about a weight of a sheet to be conveyed, a overlapping unit configured to overlap the sheet to be conveyed with another sheet and convey the overlapped sheets, a stacking tray onto which a sheet bundle conveyed as overlapped sheets by the overlapping unit, or a sheet conveyed without being overlapped with another sheet by the overlapping unit, is discharged, an alignment unit configured to align sheets stacked on the stacking tray, and a control unit configured to discharge the sheet onto the stacking tray by overlapping with another sheet by the overlapping unit if information about the weight of the sheet acquired by the acquisition unit indicates weight less than predetermined weight, and discharge the sheet onto the stacking tray without overlapping with another sheet by the overlapping unit if the information about the weight of the sheet acquired by the acquisition unit indicates weight not less than the predetermined weight.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects disclosed herein and, together with the description, serve to explain the principles of the invention.

FIG. 16 illustrates sheet discharge patterns onto a stacking tray.

FIG. 17 illustrates sheet discharge patterns onto a stacking tray.

DESCRIPTION OF THE EMBODIMENTS

Various exemplary embodiments, features, and aspects of the disclosure will be described in detail below with reference to the drawings.

Figure 1:
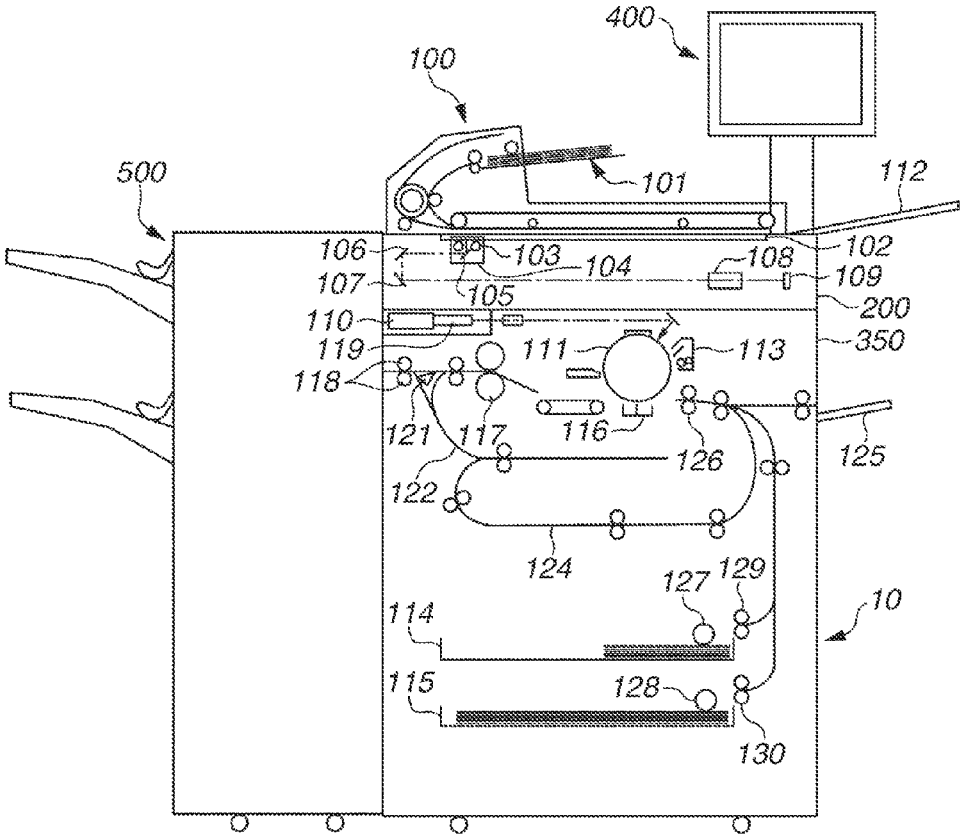
FIG. 1 is a sectional view of an image forming apparatus.

FIG. 1 is a longitudinal sectional view of the structure of a main portion of an image forming system according to a first exemplary embodiment disclosed herein. The image forming system includes an image forming apparatus 10 and a finisher 500 serving as a sheet stacking apparatus. The image forming apparatus 10 is equipped with an image reader 200 configured to read an image from a document, and a printer 350 configured to form the read image on a sheet.

A document feeding apparatus 100 feeds documents set face up on a document tray 101 one by one starting with the first page, and conveys them to a predetermined reading position on a platen glass 102. Then, the document feeding apparatus 100 discharges the documents onto a discharge tray 112. At this time, a scanner unit 104 is fixed at a predetermined reading position. When a document passes the reading position, the image of the document is read by the scanner unit 104. More specifically, when the document passes the reading position, the document is irradiated with the light of a lamp 103 of the scanner unit 104, and the reflected light from the document is guided to a lens 108 via mirrors 105, 106, and 107. The light passed through the lens 108 forms an image on the imaging surface of an image sensor 109, and the image is converted to image data and output. The image data output from the image sensor 109 is input to an exposure unit 110 of the printer 350 as a video signal.

The exposure unit 110 of the printer 350 modulates the laser beam based on the video signal input from the image reader 200 and outputs the modulated laser beam. The laser beam is applied to a photosensitive drum 111 while undergoing scanning by a polygon mirror. An electrostatic latent image corresponding to the scanned laser beam is formed on the photosensitive drum 111. The electrostatic latent image on the photosensitive drum 111 is visualized as a developer image by developer supplied from a developing device 113.

A sheet is fed from an upper cassette 114 or a lower cassette 115 provided within the printer 350 by a pickup roller 127 or 128. The fed sheet is conveyed to registration rollers 126 by sheet feeding rollers 129 or sheet feeding rollers 130. When the leading edge of the sheet reaches the registration rollers 126, the registration rollers 126 are driven with a predetermined timing, and the sheet is conveyed to a gap between the photosensitive drum 111 and a transfer unit 116.

The developer image formed on the photosensitive drum 111 is transferred to the fed sheet by the transfer unit 116. The sheet to which the developer image has been transferred is conveyed to a fixing unit 117, which fixes the developer image onto the sheet by applying heat and pressure to the sheet. The sheet passed through the fixing unit 117 is discharged from the printer 350 toward the exterior of the image forming apparatus (the finisher 500) by way of a flapper 121 and discharge rollers 118. When image formation is performed on both sides of the sheet, the sheet is conveyed to a two-sided conveyance path 124 via a reversing path 122 and is further conveyed to the registration rollers 126 again.

Figure 2:
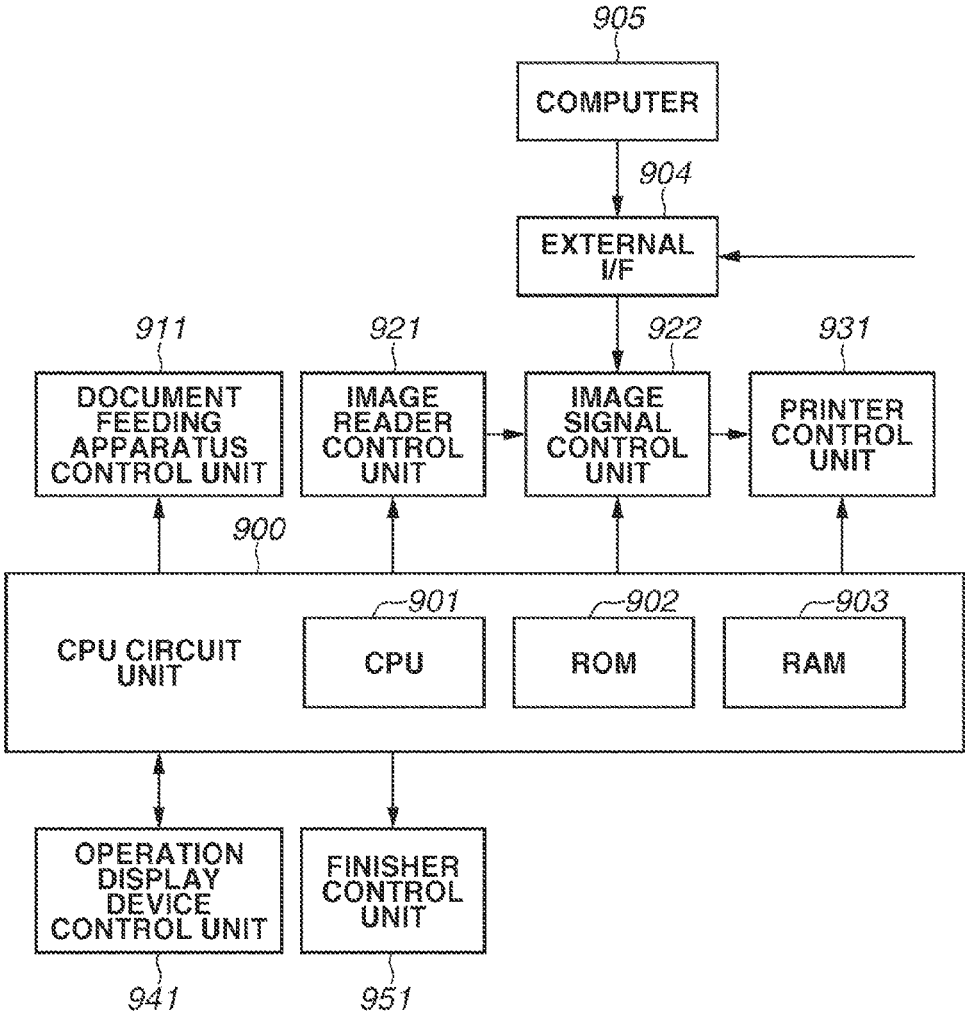
FIG. 2 is a block diagram illustrating a configuration of an image forming system.

The configuration of a controller which controls the present image forming system as a whole and the overall system configuration is described with reference to the block diagram in FIG. 2. FIG. 2 is the block diagram illustrating the configuration of the controller for controlling the image forming system as a whole in FIG. 1.

As illustrated in FIG. 2, the controller includes a central processing unit (CPU) circuit unit 900, and the CPU circuit unit 900 contains a CPU 901, a read-only memory (ROM) 902, and a random-access memory (RAM) 903. The CPU 901 is a CPU for performing the basic control of the entire present image forming system, and the ROM 902 to which a control program is written and the RAM for performing the processing are connected to the CPU 901 by an address bus and a data bus. The CPU 901 collectively controls various types of control units 911, 921, 922, 904, 931, 941, and 951 by the control program stored in the ROM 902. The RAM 903 temporarily stores the control data and is used as an operation area for a computation processing involved in the control.

The document feeding apparatus control unit 911 controls the drive of the document feeding apparatus 100 based on a command from the CPU circuit unit 900. The image reader control unit 921 controls the drive of the scanner unit 104, the image sensor 109, and the like, and transfers an image signal output from the image sensor 109 to the image signal control unit 922. The image signal control unit 922 performs each processing after converting the analog image signal from the image sensor 109 to a digital signal, and converts the digital signal to a video signal to output it to the printer control unit 931. Further, the image signal control unit 922 performs various types of processing on a digital image signal input from the computer 905 via an external interface (I/F) 904, and converts the digital image signal to a video signal to output it to the printer control unit 931. The processing operation by the image signal control unit 922 is controlled by the CPU circuit unit 900.

The printer control unit 931 controls the exposure unit 110 and the printer 350 based on the input video signal and performs image formation and sheet conveyance. The finisher control unit 951 is mounted in the finisher 500, and controls the drive of the entire finisher through information exchange with the CPU circuit unit 900. The content of the control is described in detail below. The operation display device control unit 941 exchanges information between an operation display device 400 and the CPU circuit unit 900. The operation display device 400 includes a plurality of keys for setting various functions related to image formation, a display unit for displaying information indicating the setting condition, and the like. A key signal corresponding to each key is output to the CPU circuit unit 900, and corresponding information is displayed on the operation display device 400 based on a signal from the CPU circuit unit 900.

Figure 3:
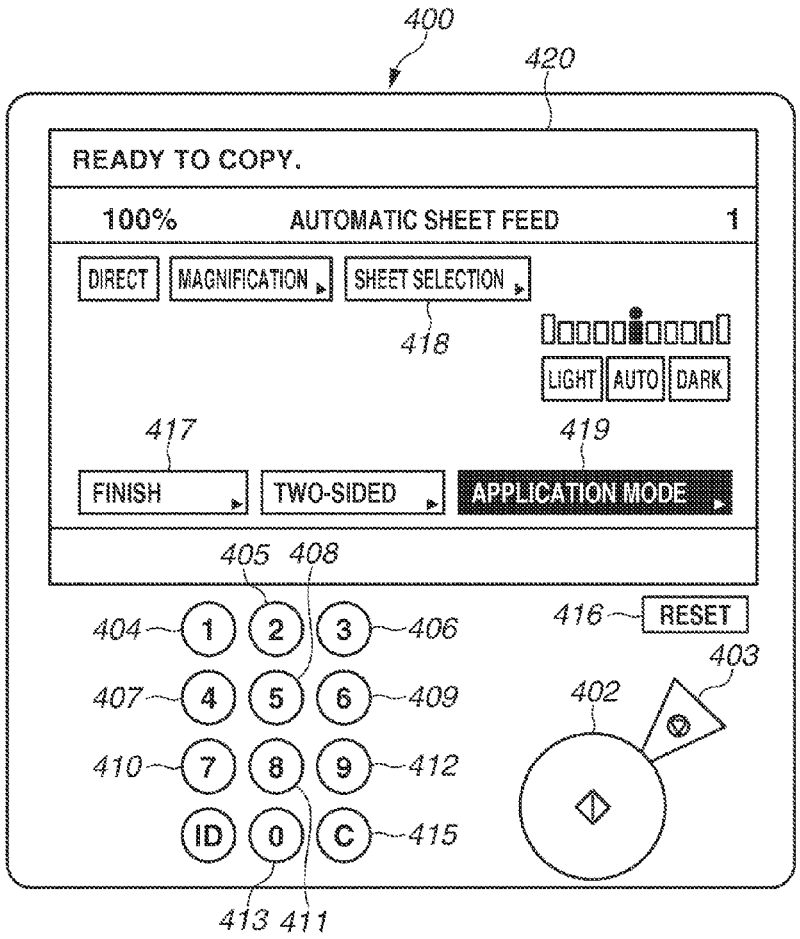
FIG. 3 illustrates an operation display device.

FIG. 3 illustrates the operation display device 400 in the image forming apparatus in FIG. 1. Arranged on the operation display device 400 are a start key 402 for starting image forming operation, a stop key 403 for interrupting the image forming operation, numeric keys 404 through 413 for numerical setting, a clear key 415, a reset key 416, and the like. Further, there is arranged a display unit 420 on whose surface a touch panel is formed, making it possible to form soft keys on the screen.

The image forming apparatus according to the present exemplary embodiment has, as post-processing modes, various processing modes, such as a non-sort mode, a sort mode, a shift mode, and a staple mode (a binding mode). The setting of such processing modes and the like is performed through an input operation from the operation display device 400. For example, when a post-processing mode is set, a "finishing" key 417 is selected on the initial screen illustrated in FIG. 3. Then, a menu selection screen is displayed on the display unit 420, and the setting of the processing mode can be performed by the selection screen.

Figure 4A:
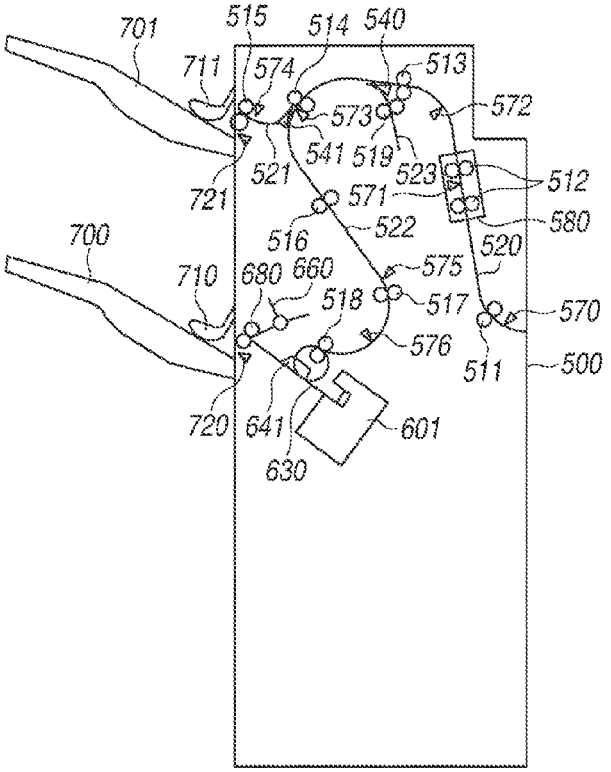
FIGS. 4A and 4B are sectional views of a finisher.
Figure 4B:
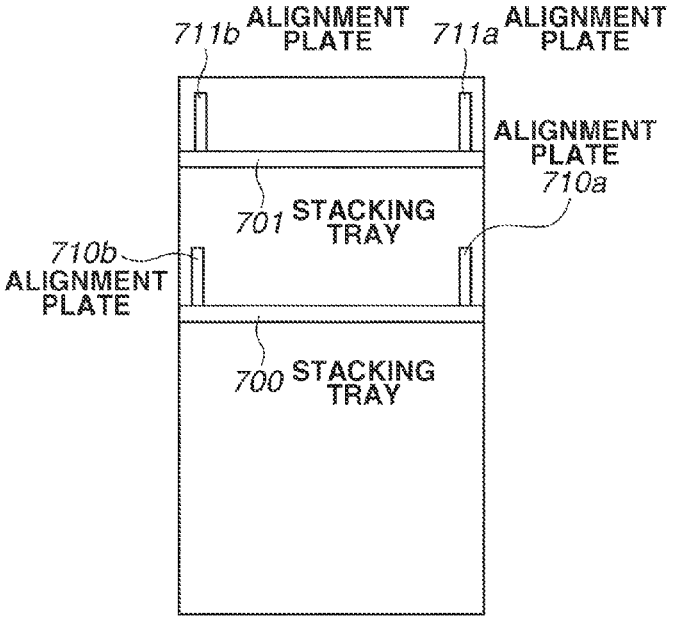

Next, the configuration of the finisher 500 is described with reference to FIGS. 4A and 4B. FIGS. 4A and 4B are schematic diagrams illustrating the configuration of the finisher 500 in FIG. 1. FIG. 4A is a front view of the finisher 500, and FIG. 4B illustrates a stacking tray 701 included in the finisher 500 as seen from the sheet discharge side.

The finisher 500 performs various types of sheet post-processing, such as the processing for successively taking in the sheets discharged from the image forming apparatus 10 and aligning and binding a plurality of the sheets into a single bundle, and the stapling in which the trailing edge of the sheet bundle is stitched by the staple. The finisher 500 takes the sheets discharged from the image forming apparatus 10 into a conveyance path 520 by a conveyance roller pair 511. The sheet taken in by the conveyance roller pair 511 is conveyed via conveyance roller pairs 512, 513, and 514. Conveyance sensors 570, 571, 572, and 573 are provided in the conveyance path 520, each detecting the passage of a sheet. The conveyance roller pair 512 is provided in a shift unit 580 together with the conveyance path sensor 571.

The shift unit 580 can move the sheet in a sheet width direction, which is orthogonal to the sheet conveyance direction, by a shift motor M5 described below. When the shift motor M5 is driven in a state in which the conveyance roller pair 512 pinches the sheet, the sheet can be offset in the width direction while being conveyed. In the shift sort mode, the position of the sheet bundle is shifted in the width direction for each copy. The offset amount is 15 mm on the front side (front shift) or 15 mm on the back side (back shift) with respect to the central position in the width direction. When there is no shift designation, the sheet is discharged to the same position as in the case of the front shift. When it is detected through the input of the conveyance sensor 571 that the sheet has passed the shift unit 580, the finisher 500 drives the shift motor M5, and restores the shift unit 580 to the center position.

Between the conveyance roller pairs 513 and 514, there is arranged a switching flapper 540 configured to guide the sheet, which is reversely conveyed by the conveyance roller pair 514, to a buffer path 523. The switching flapper 540 is driven by a solenoid SL1 described below. Between the conveyance roller pairs 514 and 515, there is arranged a switching flapper 541 configured to switch a conveyance path between an upper sheet discharge path 521 and a lower sheet discharge path 522. The switching flapper 540 is driven by a solenoid SL1 described below.

A buffer path 523 is provided for the purpose of retaining a sheet conveyed from the image forming apparatus therein and overlapping the sheet together with a subsequent sheet (i.e., buffering processing), when post-processing such as stapling is performed on a sheet bundle. The buffering processing helps to secure a time required for staple processing on the sheet bundle and to prevent a reduction in productivity without having to enlarge a sheet conveyance interval.

In the finisher 500 according to the present exemplary embodiment, even when no staple processing is performed, the buffering processing is performed on a sheet whose grammage is less than a predetermined value (less than 64 gsm in the present exemplary embodiment). Accordingly, by overlapping a plurality of thin sheets one upon the other, the lack of strength with respect to the sheet conveyance direction and the slowness in discharge due to the sheet lightness can be mitigated, and deterioration in stacking property due to the alignment performed by tray alignment plates 710 and 711 provided on the stacking trays 700 and 701 can be prevented.

However, when alignment is simultaneously performed on a plurality of sheets on the stacking tray, there are several factors such that a return member in the conveyance direction comes contact with only the uppermost sheet, and also in alignment in a direction orthogonal to the conveyance direction, friction develops between sheets, or so on, so that the alignment property deteriorates as compared with the case where alignment is performed on each sheet. Further, when sheets with predetermined weight or more are discharged while overlapped one upon the other, the sheet bundle becomes rather heavy, so that it may cause a phenomenon in which, when discharging the sheet bundle, an already stacked sheet brought into contact therewith is pushed out, resulting in further deterioration in alignment property. Therefore, it is desirable to perform the buffering processing only on the sheets which may cause defective alignment due to the lack of strength and the lightness, and to stack and align other sheets singly as much as possible. Details on the buffering processing will be described below.

When the switching flapper 541 is switched to the upper sheet discharge path 521 side, the sheet is guided to the upper sheet discharge path 521 by the conveyance roller pair 514 driven by a buffer motor M2, and is discharged onto the stacking tray 701 by the conveyance roller pair 515 driven by a sheet discharge motor M3. A conveyance sensor 574 as a sheet detection unit is provided on the discharge path 521, and serves to detect passage of a sheet. When the switching flapper 541 is switched to the lower sheet discharge path 522 side, the sheet is guided to the lower sheet discharge path 522 by the conveyance roller pair 514 driven by the buffer motor M2. The sheet is further guided to a processing tray 630 by conveyance roller pairs 517 and 518 driven by the sheet discharge motor M3. Conveyance sensors 575 and 576 are provided in the lower sheet discharge path 522, and serves to detect the passage of the sheet.

The sheet guided to the processing tray 630 is discharged onto the processing tray 630 or a stacking tray 700 according to the post-processing mode by a bundle discharge roller pair 680 driven by a bundle discharge motor M4.

In addition, as illustrated in FIG. 4B, there are arranged alignment plates 711*a* (first alignment member) and 711*b* (second alignment member) on the stacking tray 701. The alignment plates 711*a* and 711*b* serves as alignment members for aligning the positions in the sheet width direction of the sheets discharged onto the stacking tray 711. Similarly, as illustrated in FIG. 4B, there are arranged alignment plates 710*a* and 710*b* on the stacking tray 700. The alignment plates 710*a* and 710*b* align the positions in the width direction of the sheets discharged onto the stacking tray on the stacking tray 700. The alignment plates 710*a* and 710*b* can be moved in the sheet width direction by lower tray alignments motors M10 and M11 described below, respectively. The alignment plate 710*a* is arranged on the front side, and the alignment plate 710*b* is arranged on the back side.

Figure 6A:
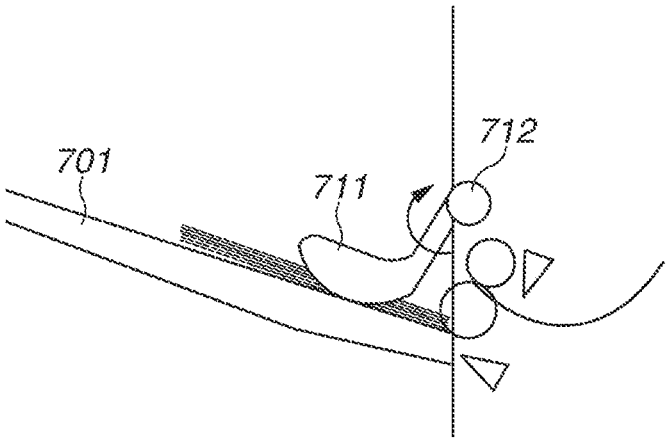
FIGS. 6A and 6B illustrate positions of a stacking tray and an alignment plate.

The alignment plates 711*a* and 711*b* are respectively driven by upper tray alignment motors M8 and M9 described below in a similar fashion. The alignment plate 711*a* is arranged on the front side, and the alignment plate 711*b* is arranged on the back side. Further, the alignment plates 710 and 711 are respectively moved vertically around an alignment plate shaft 712 between an alignment position (FIG. 6A) and a retracted position (FIG. 6B) by an upper tray alignment plate elevating motor M12 and a lower tray alignment plate elevating motor M13.

Each alignment plate is moved to the alignment position when performing alignment on the sheet on the stacking tray, and is moved to the standby position when a sheet offset direction is changed (e.g., from the front shift to the back shift), which is described in detail below. Further, each alignment plate is moved in a direction perpendicular to the conveyance direction to a position according to the subsequent sheet by upper tray alignment motors M8 and M9 or the lower tray alignment motors M10 and M11. Then, each alignment plate is returned to the alignment position by the upper tray alignment plate elevating motor M12 or the lower tray alignment plate elevating motor M13.

The stacking trays 700 and 701 can be raised and lowered by tray elevating motors M14 and M15 described below. Sheet surface detection sensors 720 and 721 detect the tray surface or the uppermost surface the sheets on the tray. The finisher 500 drives the tray elevating motors M14 and M15 according to the input from the sheet surface detection sensors 720 and 721, thereby effecting control such that the tray surface or the uppermost surface of the sheets on the tray is always at a fixed position. Sheet presence detection sensors 730 and 731 detect the presence of sheets on the stacking trays 700 and 701.

The sheets discharged onto the processing tray 630 in a bundle are pulled back to the trailing end side in the conveyance direction by a knurled belt 661 driven in synchronization with the conveyance roller pair 518 and a paddle 660 driven by a paddle motor M16 described below. The sheets pulled back abut a stopper 631 and stop.

Alignment members 641 provided on the front side and the back side of the processing tray 630 are moved in a direction perpendicular to the sheet conveyance direction respectively by a front alignment motor M6 and a rear alignment motor M7. Alignment processing is performed by the alignment members 641 on the sheets stacked on the processing tray 630, and the sheets are discharged onto the stacking tray 700 by a bundle discharge roller pair 680 after undergoing staple processing.

The bundle discharge roller pair 680 is driven by a bundle discharge motor M4 described below, and the upper roller of the bundle discharge roller pair 680 is supported by a rocking guide 650. The rocking guide 650 is driven by a rocking motor M19 described below, and rocks the upper roller of the bundle discharge roller pair 680 to abut the uppermost sheet on the processing tray 630. When the upper roller of the bundle discharge roller pair 680 is in contact with the uppermost sheet on the processing tray 630, the upper roller cooperates with the lower pair to discharge the sheet bundle on the processing tray 630 toward the stacking tray 700.

A stapler 601 is driven by a staple motor M17 described below to perform binding processing on the trailing end side of the sheet bundle stacked on the processing tray 630. Further, the stapler 601 is movable in a direction perpendicular to the conveyance direction along the outer periphery of the processing tray 630 by a stapler movement motor M18 described below.

Figure 5:
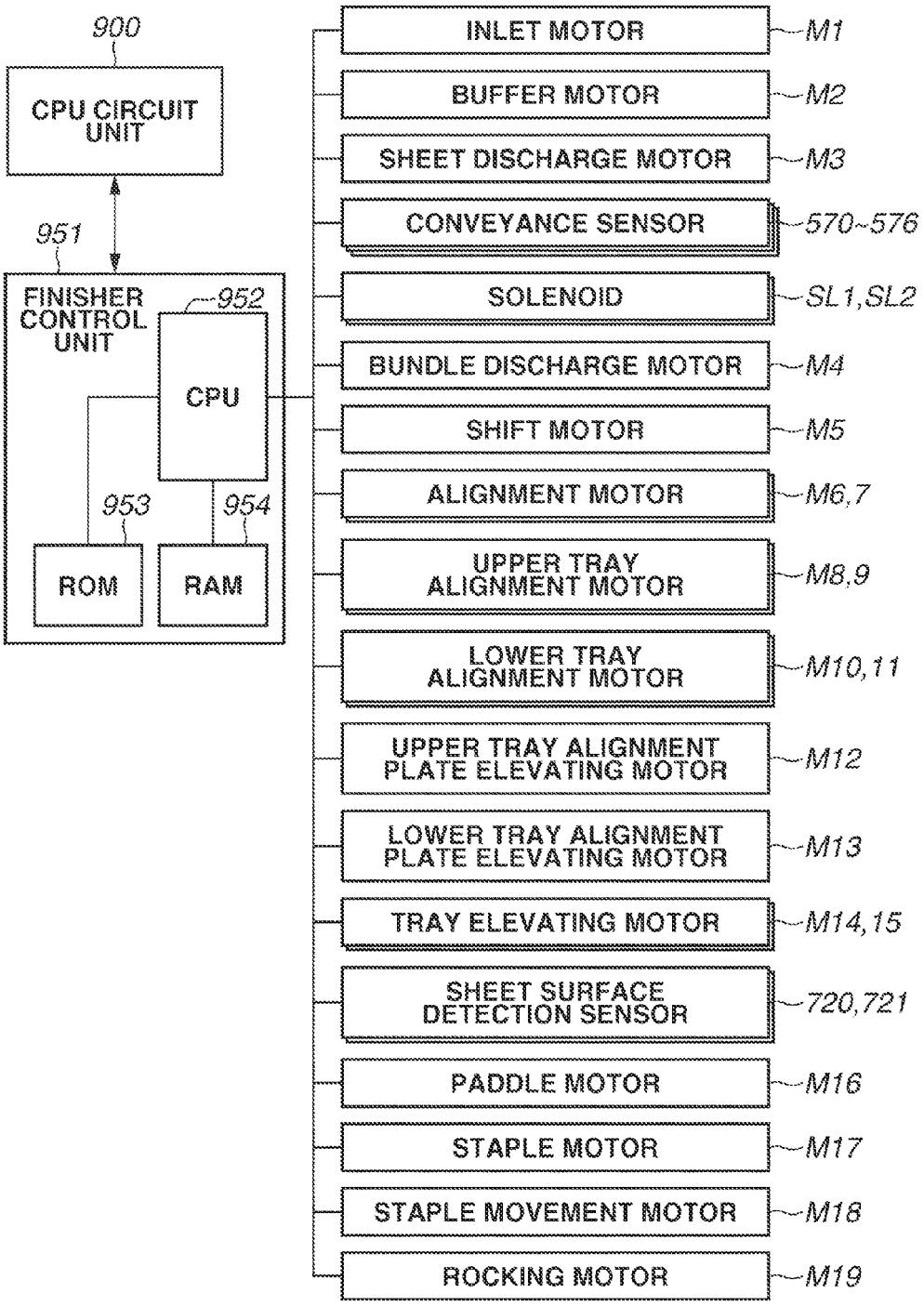
FIG. 5 is a block diagram illustrating a configuration of the finisher.

Next, the construction of the finisher control unit 951 configured to control the drive of the finisher 500 is described with reference to FIG. 5. FIG. 5 is a block diagram illustrating the configuration of the finisher control unit 951 in FIG. 2.

As illustrated in FIG. 5, the finisher control unit 951 includes a CPU 952, a ROM 953, a RAM 954, and the like. The finisher control unit 951 communicates with the CPU circuit unit 900 to perform data exchange, such as transmission and reception of commands, job information and sheet transfer notification, and executes various programs stored in the ROM 953 to control the drive of the finisher 500.

Various input and output functions that the finisher 500 includes is described. The finisher 500 is equipped with the inlet motor M1, the buffer motor 522, the sheet discharge motor M3, the shift motor M5, the solenoids SL1 and SL2, and the conveyance sensors 570 through 576 for driving the conveyance roller pairs 511 through 513 for the conveyance of sheets. Further, as the units for driving the various members of the processing tray 630, the finisher 500 is equipped with the bundle discharge motor M4 for driving the bundle discharge roller 680, alignment motors M6 and M7 for driving the alignment member 641, and the rocking motor M19 for elevating a rocking guide.

Further, the finisher 500 is equipped with the paddle motor M16 for driving the paddle 660, the staple motor M17 for driving the stapler 601, and the stapler movement motor M18 for moving the stapler 601 in the direction perpendicular to the sheet conveyance direction. Further, the finisher 500 is equipped with the tray elevating motors M14 and M15 for elevating the stacking trays 700 and 701, and the sheet surface detection sensors 720 and 721. Further, the finisher 500 is equipped with the upper tray alignment motors M8 and M9 and the lower tray alignment motors M10 and M11 for performing an alignment operation on the stacking trays, the upper tray alignment plate elevating motor M12, and the lower tray alignment plate elevating motor M13.

The sheet conveyance in the finisher 500 will be described in relation to the modes of the shift sort mode and the staple mode.

First, the sheet flow in the shift sort mode will be described with reference to FIGS. 3, 7A to 7C, 8A to 8J, 9A to 9C, and 10A and 10B and the flowcharts in FIGS. 11 and 12. When a user presses a "sheet selection" key 418 on the initial screen illustrated in FIG. 3 on the operation display device 400 of the image forming apparatus 10, a sheet feeding tray selection screen as illustrated in FIG. 10A is displayed on the display unit 420.

When setting sheets in the cassette 114 or 115, the user inputs, at the display unit 420, grammage (not illustrated) as information related to the weight of the sheets set in the sheet feeding cassette. In the present exemplary embodiment, the grammage of the plain paper is not less than 64 and less than 257 gsm, the grammage of the thin paper is less than 64 gsm, and the grammage of the thick paper is 257 gsm or more. The type of a sheet thickness according to the set grammage is displayed on the sheet feeding tray selection screen.

When executing a print job, the CPU 901 of the image forming apparatus 10 transmits sheet grammage information to the CPU 952 of the finisher along with sheet size information. According to the present exemplary embodiment, the CPU 952 of the finisher 500 determines the type of thickness of the sheet acquired from the CPU 901 based on the input "grammage." In addition, it is also possible to determine the type of sheet thickness based on input information such as "thickness" instead of "grammage."

Figure 9A:
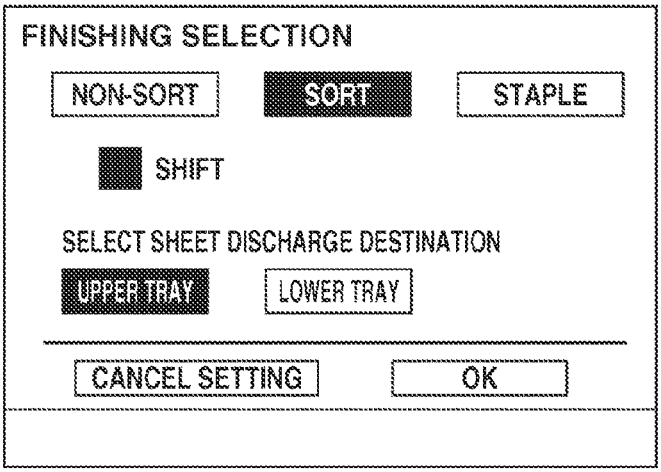
FIGS. 9A through 9C illustrate finishing mode selection screens.
Figure 10A:
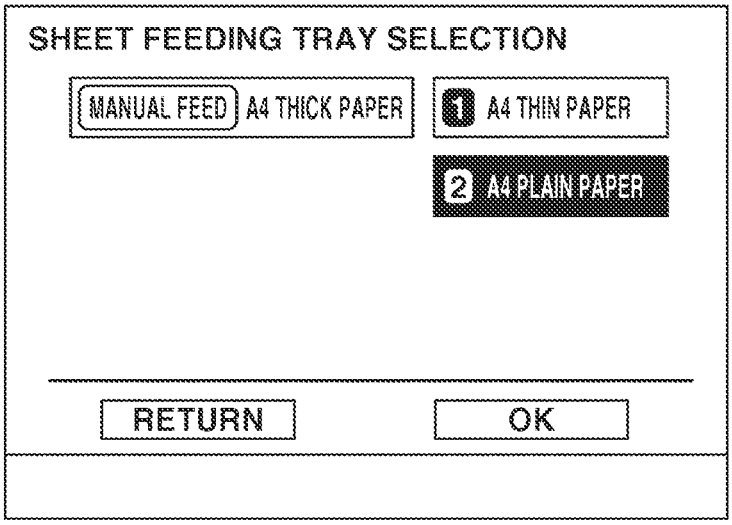
FIGS. 10A and 10B illustrate a sheet feeding tray selection screen.
Figure 10B:
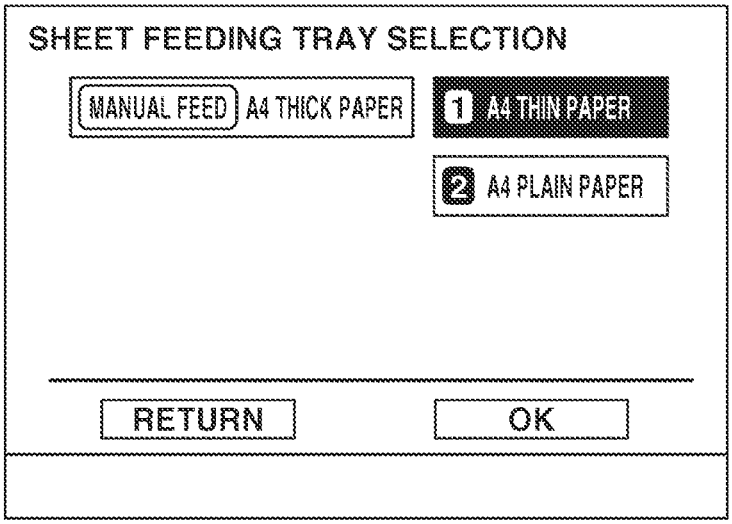

When the user selects a "finishing" key 417 on the initial screen in the operation display device 400 illustrated in FIG. 3, a finishing menu selection screen as illustrated in FIG. 9A is displayed on the display unit 420. When, after selecting the "sort" key and "shift" key in FIG. 9A, the user presses the OK key, the shift sort mode is set. In the present exemplary embodiment, the "shift" key is selected by default.

The sort mode is a mode in which, sorting is performed for each copy set constituting a document to conduct image formation and stacking the sheets onto the stacking tray in the image forming apparatus 10. The shift sort mode is a mode in which, the sheets are stacked on the stacking tray while offset for each copy thereof in the finisher 500. In the case of the sort mode with no shift designation, the sheets of each copy are stacked at the same position on the stacking tray without being offset.

In the finishing menu selection screen illustrated in FIG. 9A, it is possible to select the tray onto which the sheets are discharged. Here, the case where the "upper tray" key is selected will be described.

When a job designated to the shift sort mode is input, the CPU 901 in the CPU circuit unit 900 informs the CPU 952 in the finisher control unit 951 of information related to the job, such as a size, a grammage, a sheet shifting direction, and a sheet discharge destination, for each sheet. Based on these pieces of the information, the finisher control unit 951 determines whether to perform a buffer operation.

In the following, the sheet conveyance in the shift sort mode will be described with reference to FIGS. 7A to 7C. When a sheet P is discharged from the image forming apparatus 10 to the finisher 500, the CPU 901 in the CPU circuit unit 900 informs the CPU 952 in the finisher control unit 951 that the transfer of the sheet is to be started. Upon receiving the sheet transfer start information, the CPU 952 drives the inlet motor M1, the buffer motor M2, and the sheet discharge motor M3. Accordingly, as illustrated in FIG. 7A, the conveyance roller pairs 511, 512, 513, and 514 are rotated, and the sheet P discharged from the image forming apparatus 10 is taken into the finisher 500 and conveyed.

In this process, when the conveyance sensor 571 detects that the sheet is conveyed to the position where the conveyance roller pair 512 pinches the sheet P, the CPU 952 drives the shift motor M5, and moves the shift unit 580 to offset the sheet P. When the sheet shift information notified from the CPU 901 indicates the "front" side, the sheet is offset to the front side by 15 mm with respect to the center in the sheet width direction, and when the sheet shift information supplied indicates the "back" side, the sheet is offset to the back side by 15 mm with respect thereto.

Figures 7A, 7B, 7C:
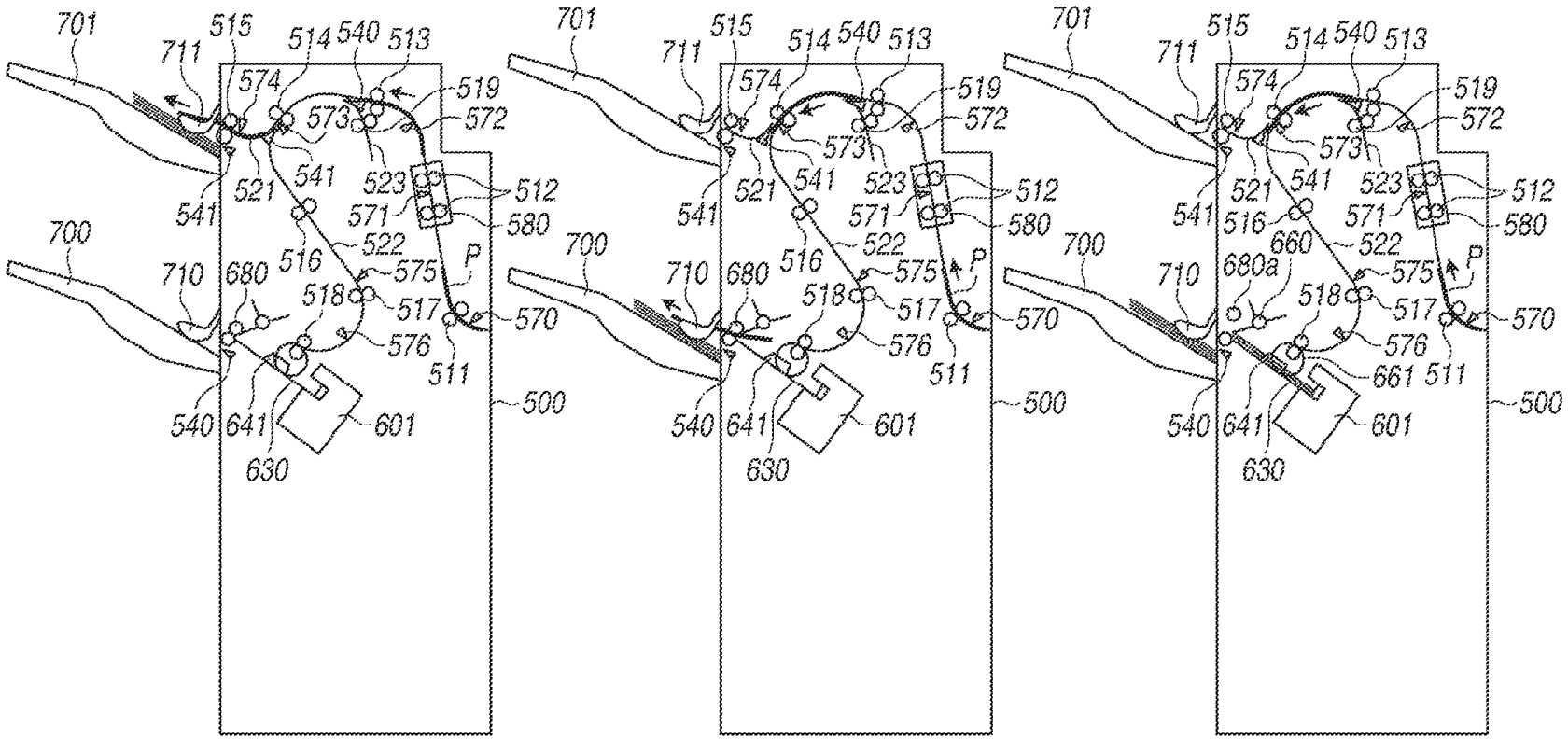
FIGS. 7A through 7C illustrate sheet conveyance in the finisher.

In the case where the stacking tray 701 (upper tray) is selected as the discharge destination, the CPU 952 drives the solenoid SL2 so that the switching flapper 541 may be moved to the position illustrated in FIG. 7A. As a result, the sheet P is guided to the upper discharge path 521. When the passage of the trailing edge of the sheet P is detected by the conveyance sensor 574, the CPU 952 rotates the sheet discharge motor M3 at a speed suitable for stacking, and the sheet P is discharged onto the stacking tray 701 by the conveyance roller pair 515.

When the stacking tray 700 (lower tray) is selected as the discharge destination, the CPU 952 drives the solenoid SL2 so that the switching flapper 541 may be moved to the position illustrated in FIG. 7B. As a result, the sheet P is guided to the lower discharge path 522. When the passage of the trailing edge of the sheet P is detected by the conveyance sensor 576, the CPU 952 rotates the bundle discharge motor M4 at a speed suitable for stacking, and the sheet P is discharged onto the stacking tray 700 by the bundle discharge roller pair 680.

Next, the buffer mode setting control will be described with reference to the flowcharts in FIGS. 11 and 12. In the following, the processing by the CPU 952 in the finisher control unit 951 will be described.

Figure 11:
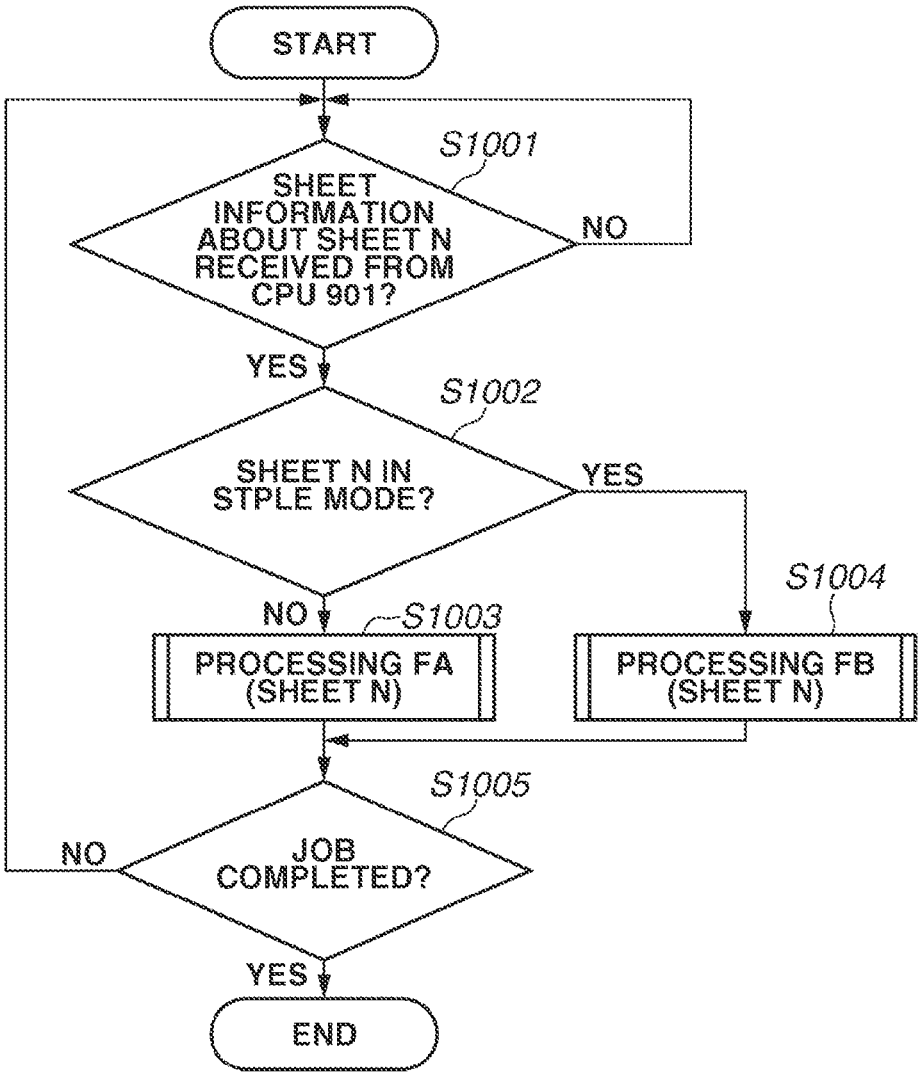
FIG. 11 is a flowchart illustrating a main routine of sheet conveyance control.

FIG. 11 is the flowchart illustrating the buffer mode setting control executed by the CPU 952. The processing of each step is conducted for each sheet. In step S1001, the CPU 952 determines whether the sheet information of the sheet N is received from the CPU 901, and in step S1002, further determines whether stapling is designated based on the received sheet information. As disclosed throughout this document and understood by the skilled artisan, the term "N", as used in "sheet N," is a natural number. If there is no staple designation (NO in step S1002), then in step S1003, the CPU 952 executes the processing FA (illustrated in the flowchart in FIG. 12). Whereas if there is staple designation (YES in step S1002), then in step S1004, the CPU 952 executes the processing FB (illustrated in the flowchart in FIG. 15). The CPU 952 repeats the above processing until the job is completed (S1005).

The processing of transmitting the sheet information from the CPU 901 to the CPU 952 is executed before the image formation on the sheet N in the image forming apparatus 10. According to the present exemplary embodiment, before the sheet N reaches the finisher 500, the CPU 952 receives sheet information of a sheet N+1, which is a sheet subsequent to the sheet N.

Figure 12:
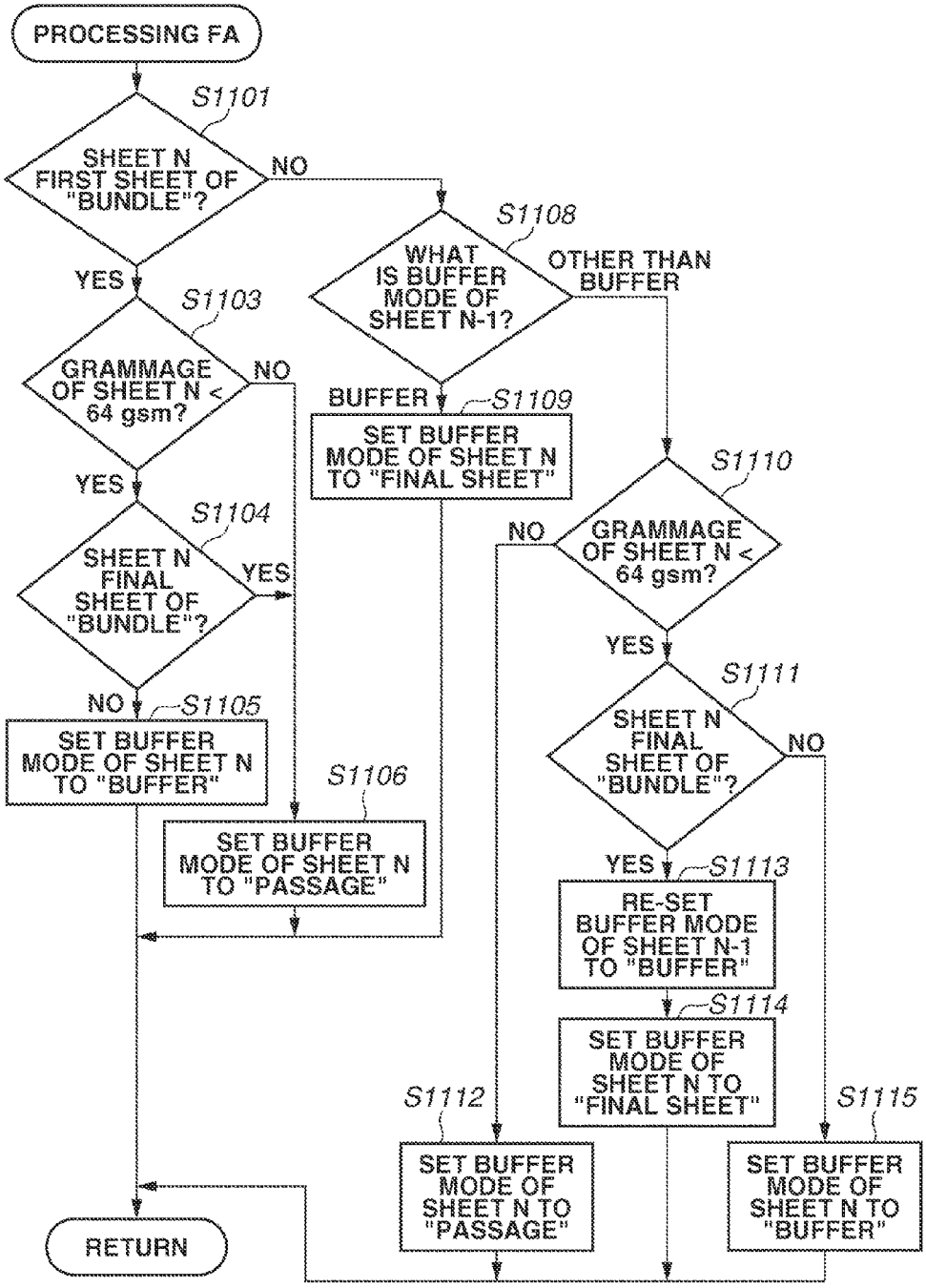
FIG. 12 is a flowchart illustrating buffer mode setting processing in a non-staple mode.

FIG. 12 is a flowchart illustrating in detail the buffer mode setting processing in a job other than the staple designation such as the shift sort mode.

In step S1101, the CPU 952 determines whether the sheet N is the first sheet of the bundle (i.e., a set of copy) based on the sheet information received from the CPU 901. When the sheet N is the first sheet of the bundle (YES in step S1101), the processing proceeds to step S1103. Otherwise (NO in step S1101), the processing proceeds to step S1108.

In step S1103, the CPU 952 determines whether the grammage of the sheet N is less than 64 gsm based on the sheet information of the sheet N. When the grammage is less than 64 gsm (YES in step S1103), the processing proceeds to step S1104, and when the grammage is not less than 64 gsm (NO in step S1103), the processing proceeds to step S1106.

In step S1106, the CPU 952 set the buffer mode of the sheet N to "passage." The information of the buffer mode set is stored in the RAM 954.

In step S1104, the CPU 952 determines whether the sheet N is the final sheet of a set of the copy based on the sheet information. When the sheet N is the final sheet (YES in step S1104), the processing proceeds to step S1106. Otherwise (NO in step S1104), the processing proceeds to step S1105.

In step S1105, the CPU 952 sets the buffer mode of the sheet N to "buffer." When the buffer mode of the sheet N is "passage," it means that the sheet N is not conveyed to the buffer path 523 but is singly conveyed to the downstream side. When the buffer mode of the sheet N is "buffer," it means that the sheet N is conveyed to the buffer path 523.

When, in step S1101, it is determined that the sheet N is not the first sheet of the set of the copy (NO in step S1101), then in step S1108, the CPU 952 determines the buffer mode of a preceding sheet N−1 stored in the RAM 954. When the buffer mode is "buffer" (BUFFER in step S1108), the processing proceeds to step S1109. Otherwise (OTHER THAN BUFFER in step S1108), the processing proceeds to step S1110.

In step S1109, the CPU 952 set the buffer mode of the sheet N to "final sheet." When the buffer mode of the sheet N is "final sheet," it means that the sheet N is conveyed while overlapped together with the sheet N−1 conveyed from the buffer path 523.

In step S1110, the CPU 952 determines whether the grammage of the sheet N is less than 64 gsm. When the grammage is 64 gsm or more (NO in step S1110), then in step S1112, the CPU 952 sets the buffer mode of the sheet N to "passage." When the grammage is less than 64 gsm (YES in step S1110), then in step S1111, the CPU 952 determines whether the sheet N is the final sheet of the set of the copy.

When the sheet N is not the final sheet of the set of the copy (NO in step S1111), then in step S1115, the CPU 952 sets the buffer mode of the sheet N to "buffer." When the sheet N is the final sheet of the set of the copy (YES in step S1111), in step S1113, the CPU 952 sets the buffer mode of the preceding sheet N−1 stored in the RAM 954 to "buffer" again. Then in step S1114, the CPU 952 sets the buffer mode of the sheet N to "final sheet."

In each of the steps S1105, S1106, S1112, S1114, and S1115, when the buffer mode is set, the processing FA is completed, and the processing returns to the routine in FIG. 11.

In the processing FA, when all the sheets used in the job are the plain paper of 64 gsm or more, the buffer mode is always set to "passage" in the shift sort mode, and no buffer processing is executed.

Next, the alignment operation to be performed on the sheets discharged on the stacking tray 701 in the shift sort mode will be described with reference to FIGS. 8A through 8J and the flowchart in FIG. 18. Here, the case will be described where a first sheet group (hereinafter referred to as the "a set of copy") is stacked on the front side of the stacking tray 701 and where a next "set of copy" is stacked on the back side thereof. This configuration is also applied to the case where stacking is performed on the stacking tray 700. As described above, whether to offset the sheets on the front side or the backside is determined based on the sheet information informed from the CPU circuit unit 900.

Figure 8A:
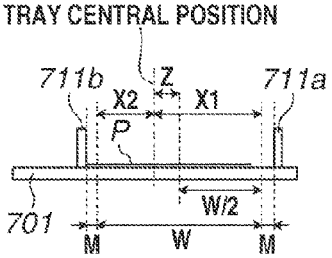
FIGS. 8A through 8J illustrate a sheet alignment operation.

FIG. 8A illustrates the stacking tray 701 as seen from the sheet discharge side in the case where the offset direction is on the front side. Assuming that a width of the discharged sheet P is W and a shift amount thereof is Z, as illustrated in FIG. 8A, the front side alignment plate 711*a* is on standby at a position spaced away from a predetermined amount M to the front side from a position of a sheet end on the front side. This standby position is a position attained by adding the predetermined amount M to the position attained by adding the shift amount Z to half the sheet width W/2 (a position spaced away from the central position of the stacking tray 701 by a distance X1) from the central position of the stacking tray 701 toward the front side. The alignment plate 711*b* is on standby at a position spaced away from the back side sheet end position to the back side by the predetermined amount M. This standby position is a position attained by adding the predetermined amount M to the position attained by subtracting the shift amount Z from half the sheet width W/2 (a position spaced away from the central position of the stacking tray 701 by a distance X2) from the central position of the stacking tray 701 toward the back side.

Figure 18:
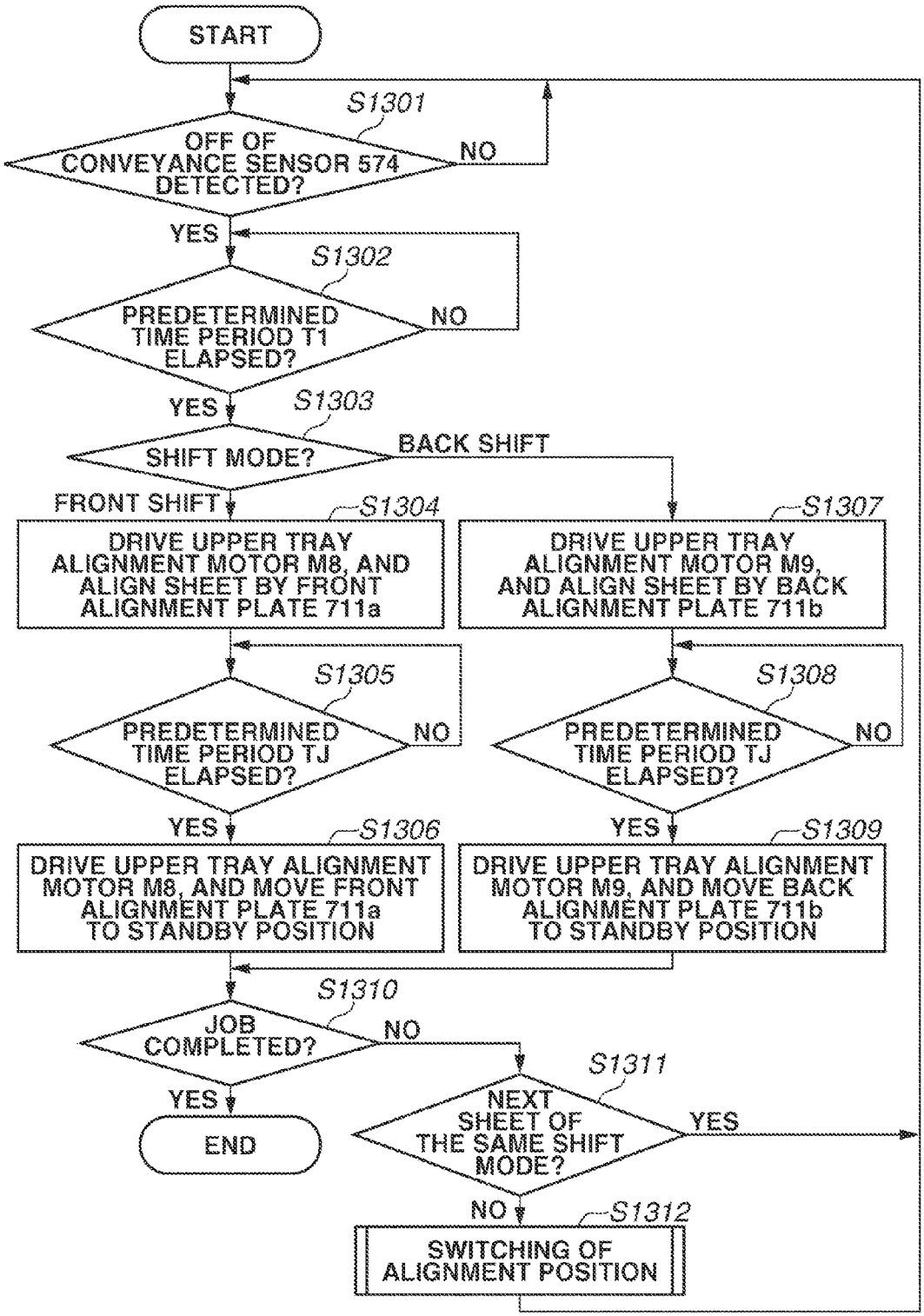
FIG. 18 is a flowchart illustrating a sheet alignment operation.

FIG. 18 is a flowchart illustrating the alignment operation at the stacking tray 701 to be executed by the CPU 952. In step S1301, the CPU 952 determines whether a trailing edge of a sheet has passed the conveyance sensor 574.

When the trailing edge of the sheet passed the conveyance sensor 574 (YES in step S1301), then in step S1302, the CPU 952 waits for a predetermined period of time T1 to elapse. The predetermined period of time T1 is determined previously by taking into consideration the time required for conveying the sheet from the conveyance sensor 574 to the conveyance roller 515, and the time required for the sheet to fall onto the stacking tray 701 after being discharged to the exterior of the apparatus.

Figure 8B:
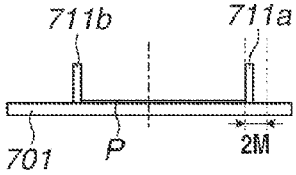

When the predetermined period of time T1 has elapsed (YES in step S1302), in step S1303, the CPU 952 determines the shift mode indicating the sheet shifting direction. When the shift mode is the front shift (FRONT SHIFT in step S1303), the processing proceeds to step S1304. In step S1304, the CPU 952 drives the upper tray alignment motor M8 such that the alignment plate 711*a* moves by a predetermined pushing-in amount 2M toward the sheet as illustrated in FIG. 8B. As a result, the sheet abuts the alignment plate 711*b*.

Then, in step S1305, the CPU 952 waits for a predetermined period of time TJ to elapse after the movement of the alignment plate 711*a*. The predetermined period of time TJ is the time waiting for the stabilization of an orientation of the sheet pushed in.

Figure 8C:
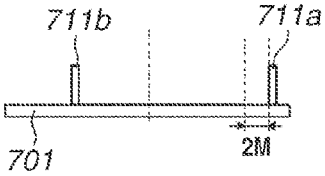

When the predetermined period of time TJ has elapsed (YES in step S1305), in step S1306, the CPU 952 drives the upper tray alignment motor M8 to return the alignment plate 711*a* by the predetermined pushing-in amount 2M as illustrated in FIG. 8C. As a result, the alignment plate 711*a* returns to the alignment standby position. When the offset amount Z is 15 mm and the predetermined pushing-in amount is 5 mm, the offset amount of the sheet from the center position after the alignment operation is 10 mm.

When, in step S1303, the shift mode is the back shift (BACK SHIFT in step S1303), then in step S1307, the CPU 952 drives the upper tray alignment motor M9 to cause the alignment plate 711*b* to move by the predetermined pushing-in amount 2M toward the sheet as illustrated in FIG. 81. As a result, the sheet abuts the alignment plate 711*a*.

Figure 8D:
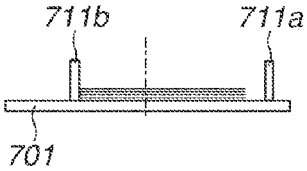
Figure 8E:
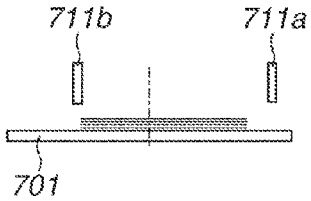

Then, in step S1308, the CPU 952 waits for the predetermined period of time TJ to elapse. When the predetermined period of time TJ has elapsed (YES in step S1308), in step S1309, the CPU 952 drives the upper tray alignment motor M9 to return the alignment plate 711*b* away from the sheet by the predetermined pushing-in amount 2M as illustrated in FIG. 8J. As a result, the alignment plate 711*b* returns to the alignment standby position.

In step S1310, the CPU 952 determines whether the job has been completed. When the job has not been completed (NO in step S1310), the processing proceeds to step S1311.

In step S1311, the CPU 952 determines the shift mode of the next sheet. When there is no change in shift mode (YES in step S1311), the processing in step S1301 and onward are repeated. When the shift mode is to be changed (NO in step S1311), the processing proceeds to step S1312.

According to the present exemplary embodiment, regardless of the grammage of the sheet, the alignment operation is performed in step S1304 or step S1307 after the predetermined period of time T1 has elapsed after the trailing edge of the sheet passed the conveyance sensor 574 in step S1301. Accordingly, it is possible to perform a satisfactory alignment operation on both plain paper singly discharged and thin paper discharged while overlapped one upon the other without reducing the productivity. If the thin paper is singly discharged, it is necessary to make the predetermined period of time T1 longer as compared with the case where the plain paper is discharged in order to perform satisfactory alignment, whereas, when a plurality of thin paper sheets is discharged while overlapped one upon the other, it is possible to fix the predetermined period of time T1 in conformity with the plain paper, thus the reduction in productivity can be prevented.

Figure 6B:
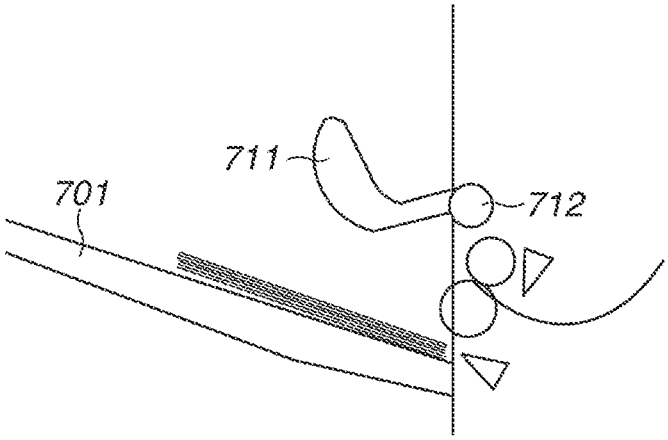

The alignment position switching processing in step S1312 will be described. For example, as illustrated in FIG. 8D, the alignment plate 711*a* returns to the standby position after the front shift alignment. As illustrated in FIG. 8E, for the alignment on the sheet bundle of the next copy, the CPU 952 drives the upper tray alignment plate elevating motor M12 to move the alignment plates 711*a* and 711*b* by a predetermined amount to upward away from the stacking tray 701. FIG. 6B illustrates the condition of the finisher 500 at this time as seen from the front side.

Figure 8F:
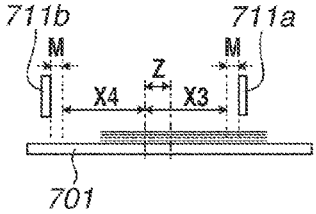

Next, as illustrated in FIG. 8F, the alignment plates 711*a* and 711*b* move to the next alignment standby position while spaced away from the stacking tray 701. The alignment plate 711*a* is kept on standby at a position spaced away by the predetermined amount M to the front side from the position of the front side sheet end. This standby position is a position attained by adding the predetermined amount M to the position attained by subtracting the shift amount Z from half the shift width W/2 (a position spaced away from the central position of the stacking tray 701 by a distance X3) toward the front side from the central position of the stacking tray 701. The alignment plate 711*b* is kept on standby at a position spaced away by the predetermined amount M to the back side from the back side sheet end position. This standby position is a position attained by adding the predetermined amount M to the position attained by adding the shift amount Z to half the sheet width W/2 (a position spaced away from the central position of the stacking tray 701 by a distance X4) toward the back side from the central position of the stacking tray 701.

Figure 8G:
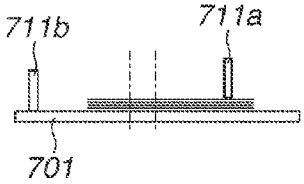
Figure 8H:
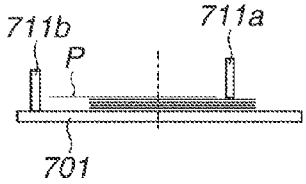
Figure 8I:
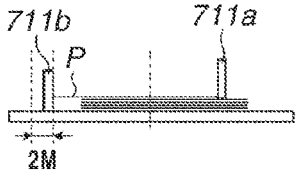
Figure 8J:
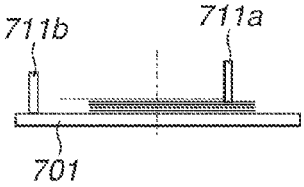

As illustrated in FIG. 8G, after the alignment plates 711*a* and 711*b* is moved to the alignment standby positions, the CPU 952 drives the upper tray alignment plate elevating motor M12 by a predetermined amount to bring the alignment plates 711*a* and 711*b* toward the stacking tray 701. As a result, the alignment plate 711*a* is placed on the sheet bundle already stacked. On the other hand, the alignment plate 711*b* is not placed on the sheet bundle already stacked but is lowered to a level below the alignment plate 711*a*.

As described above, when there is a change in the shift mode, the alignment plates are temporarily retracted upwardly away from the stacking tray, and lowered after having moved in the width direction to change the alignment position. Then, the sheets are aligned each time a sheet is discharged onto the stacking tray.

The alignment operation by the alignment plates 710*a* and 710*b* provided on the stacking tray 700 is the same as the alignment operation performed on the stacking tray 701, so the description thereof will be omitted.

FIG. 16 illustrates a relationship between a receiving pattern in which a plurality of sheets are received by the finisher 500 from the image forming apparatus 10 and a discharge pattern in which the plurality of sheets are discharged onto the stacking tray 701. For example, in the receiving pattern in each frame in FIG. 16, the farther on the left-hand side a sheet is given, the earlier the sheet is received. Further, in the discharge pattern in each frame, the farther on the left-hand side a sheet is given, the earlier the sheet is discharged. As for the items of information written in each sheet, they are as follows from above: what sheet of what copy that the sheet is; sheet size; post-processing mode; and grammage.

As in pattern 1, in the shift sort mode operation for plain paper (80 gsm), the sheet received from the image forming apparatus 10 is discharged as it is onto the stacking tray 701 without undergoing any buffering processing described above.

On the other hand, as illustrated in pattern 2 and pattern 3, in the shift sort mode operation for thin paper (52 gsm), the buffering processing is performed in two sheets or three sheets before the sheets are discharged onto the stacking tray 701. In pattern 2, the buffering processing is performed in two sheets, and the two overlapped sheets are discharged onto the stacking tray 701. By overlapping two sheets of the thin paper, weight of the sheets increases and the behavior of the sheets until they fall onto the stacking tray can be stabilized. This operation in pattern 2 will be described with reference to the flowchart in FIG. 12.

For the first sheet, the processing is performed in the order of steps S1101, S1103, S1104, and S1105. For the second sheet, the processing is performed in the order of steps S1101, S1108, and S1109. For the third sheet, the processing is performed in the order of steps S1101, S1108, S1110, S1111, and S1115. For the fourth sheet, the processing is performed in the order of steps S1101, S1108, and S1109. As a result, the first and second sheets, and the third and fourth sheets, are respectively overlapped one upon the other before being discharged onto the tray 701.

In the case where one copy is formed by three sheets, if the buffering processing is performed on two sheets, the third sheet is singly discharged. Thus, in such a case, the buffering processing is performed on three sheets in pattern 3 so as not to singly convey the thin paper. The operation in pattern 3 will be described with reference to the flowchart in FIG. 12.

For the first and second sheets, the processing performed is similar to that in the case of pattern 2. For the third sheet, the processing is performed in the order of steps S1101, S1108, S1110, S1111, S1113, and S1114. In step S1113, the buffer mode, which is set to "passage" in step S1106 for second sheet, is changed to "buffer." As a result, the first through third sheets are discharged onto the stacking tray 701 while overlapped one upon the other.

Figure 13A:
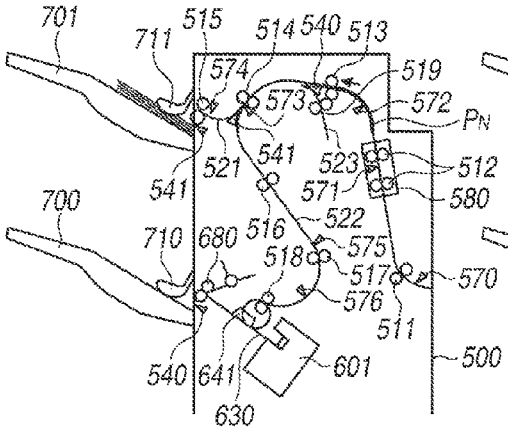
FIGS. 13A through 13F illustrate a buffer operation.
Figure 14:
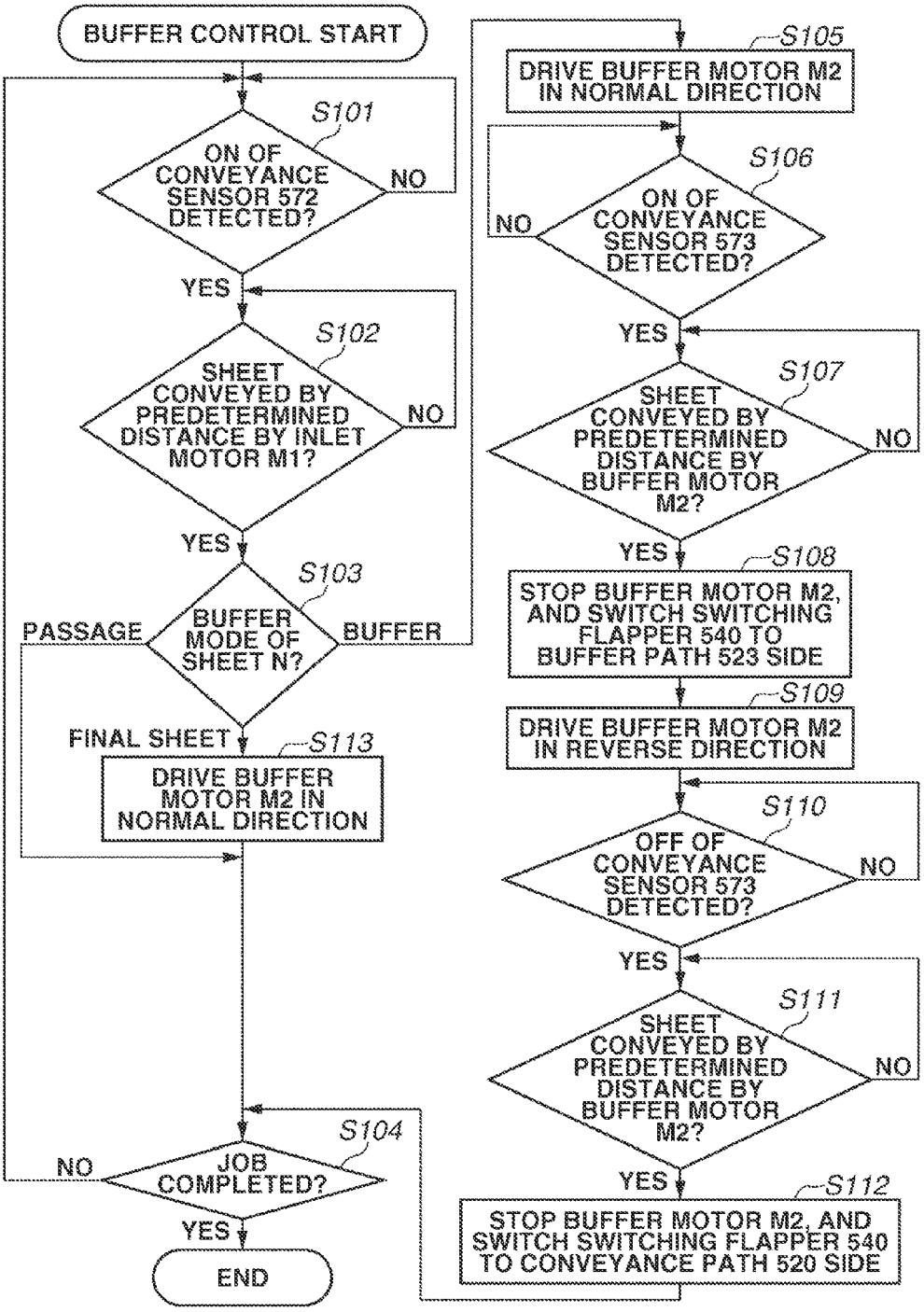
FIG. 14 is a flowchart illustrating the buffer operation.

The buffering processing executed by the CPU 952 will be described with reference to the flowchart in FIG. 14. In step S101, the CPU 952 determines whether the sheet N has reached the conveyance sensor 572. When the sheet N reaches the conveyance sensor 572 (YES in step S101), in step S102, the CPU 952 drives the inlet motor M1 to further convey the sheet N by a predetermined distance. FIG. 13A illustrates the condition of the sheet N at this time. In FIG. 13A, the sheet N is indicated by a symbol PN.

Then, in step S103, the CPU 952 determines the buffer mode of the sheet N. When the buffer mode is "buffer," the processing proceeds to step S105, and the CPU 952 drives the buffer motor M2 in normal direction.

Then, in step S106, the CPU 952 determines whether the sheet N has reached the conveyance sensor 573. When the sheet N reaches the conveyance sensor 573 (YES in step S106), in step S107, the CPU 952 determines whether the sheet N is further conveyed by a predetermined distance.

Figure 13B:
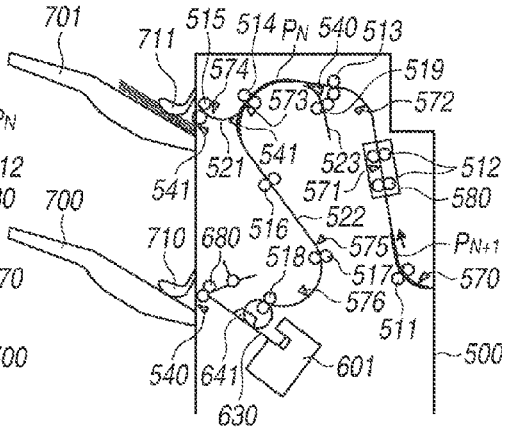

If the sheet N is conveyed by the predetermined distance (YES in step S107), then in step S108, the CPU 952 stops the buffer motor M2, and switches the switching flapper 540 to guide the sheet N to the buffer path 523 side. FIG. 13B illustrates the condition of the sheet N at this time.

Figure 13C:
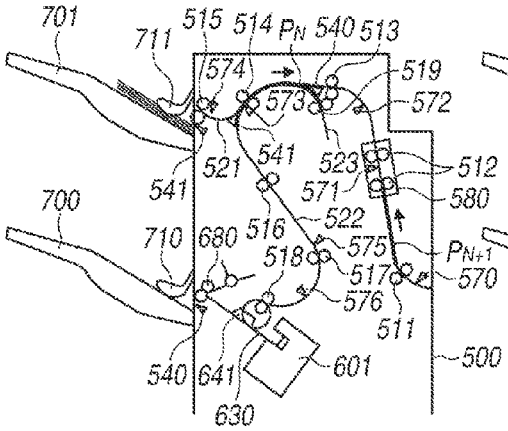

Then, in step S109, the CPU 952 drives the buffer motor M2 in the reverse direction to convey the sheet N to the buffer path 532. FIG. 13C illustrates the condition of the sheet N at this time. Then, in step S110, the CPU 952 determines whether the trailing edge of the sheet N has passed the conveyance sensor 573.

Figure 13D:
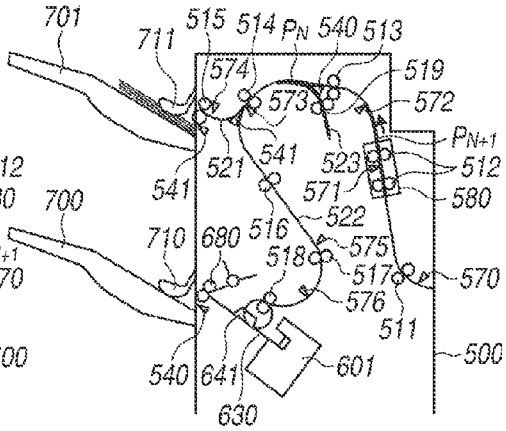

When the trailing edge of the sheet N passes the conveyance sensor 573 (YES in step S110), then in step S111, the CPU 952 determines whether the sheet N is further conveyed by a predetermined distance. When the sheet N is conveyed by the predetermined distance (YES in step S111), in step S112, the CPU 952 stops the buffer motor M2, and switches the switching flapper 540 to guide the sheet N to the conveyance path 520 side. FIG. 13D illustrates the condition of the sheet at this time.

Then, in step S104, the CPU 952 determines whether the sheet N is the final sheet of the job. If the sheet N is not the final sheet (NO in step S104), the processing from step S101 onward are repeated on the next sheet. In this case, the next sheet is processed as the sheet N.

Figure 13E:
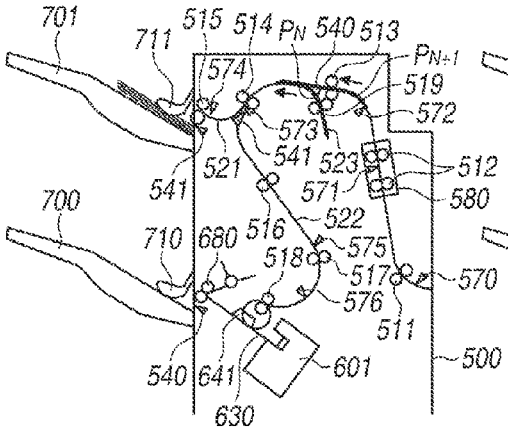
Figure 13F:
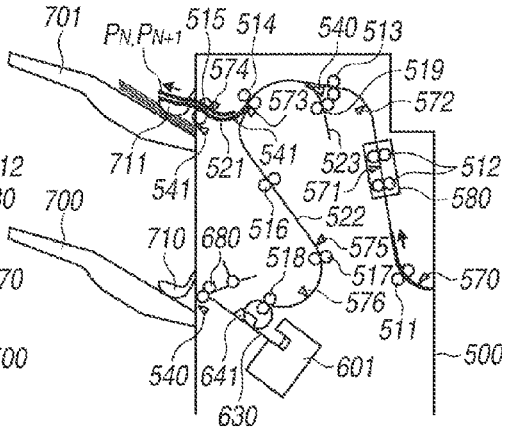

In step S103, if the buffer mode of the sheet N is the "final sheet," then in step S113, the CPU 952 drives the buffer motor M2 in the normal direction to overlap the sheet N with the preceding sheet, which is on standby at the buffer path 523, and convey the overlapped sheets downstream. FIGS. 13E and 13F illustrate the condition of the sheet N at this time.

In step S103, if the buffer mode of the sheet N is "passage," the CPU 952 conveys the sheet downstream as it is without performing any buffering processing thereon. In the case of operation on the plain paper in the shift sort mode, the buffer mode of the sheet N is "passage" in step S103 in FIG. 14, and the sheet is conveyed as it is.

The operation in the case where the stacking tray 700 ("lower tray") is selected as the discharge destination is similar to the operation in the case where the stacking tray 701 is selected as the discharge destination, so the description thereof will be omitted.

Next, the operation when there is input a job in which thin paper and plain paper are mixed with each other is described with reference to FIG. 17.

In pattern 6, the first sheet is thin paper, and the second through fourth sheets are plain paper. In this case, the first sheet undergoes buffering, and is discharged onto the stacking tray while overlapped with the second sheet. The operation in this case will be described with reference to the flowchart in FIG. 12.

For the first sheet, the processing is performed in the order of steps S1101, S1103, S1104, and S1105. For the second sheet, the processing is performed in the order of steps S1101, S1108, and S1109. For the third and fourth sheets, the processing is performed in the order of steps S1101, S1108, S1110, and S1112.

In pattern 7, the first and fourth sheets are plain paper, and the second and third sheets are thin paper. In this case, the first and fourth sheets are singly discharged, whereas the second sheet undergoes buffering and is discharged while overlapped with the third sheet. The operation in this case will be described with reference to the flowchart in FIG. 12.

For the first sheet, the processing is performed in the order of steps S1101, S1103, and S1106. For the second sheet, the processing is performed in the order of steps S1101, S1108, S1110, S1111, and S1115. For the third sheet, the processing is performed in the order of steps S1101, S1108, and S1109. For the fourth sheet, the processing is performed in the order of steps S1101, S1108, S1110, and S1112.

In pattern 8, the first, third, and fourth sheets are plain paper, and the second sheet is thin paper. In this case, as in pattern 7, the second sheet undergoes buffering, and is discharged while overlapped with the third sheet.

In pattern 9, the first and second sheets are plain paper, and the third sheet is thin paper. In this case, the third sheet is discharged while overlapped with the second sheet. The operation in this case will be described with reference to the flowchart in FIG. 12.

For the first sheet, the processing is performed in the order of steps S1101, S1103, and S1106. For the second sheet, the processing is performed in the order of steps S1101, S1108, S1110, and S1112. The buffer mode of the second sheet is temporarily set to "passage." For the third sheet, the processing is performed in the order of steps S1101, S1108, S1110, S1111, S1113, and S1114. In step S1113, the buffer mode of the second sheet is changed from "passage" to "buffer," so that the second sheet and the third sheet are discharged while overlapped one upon the other.

Figure 15:
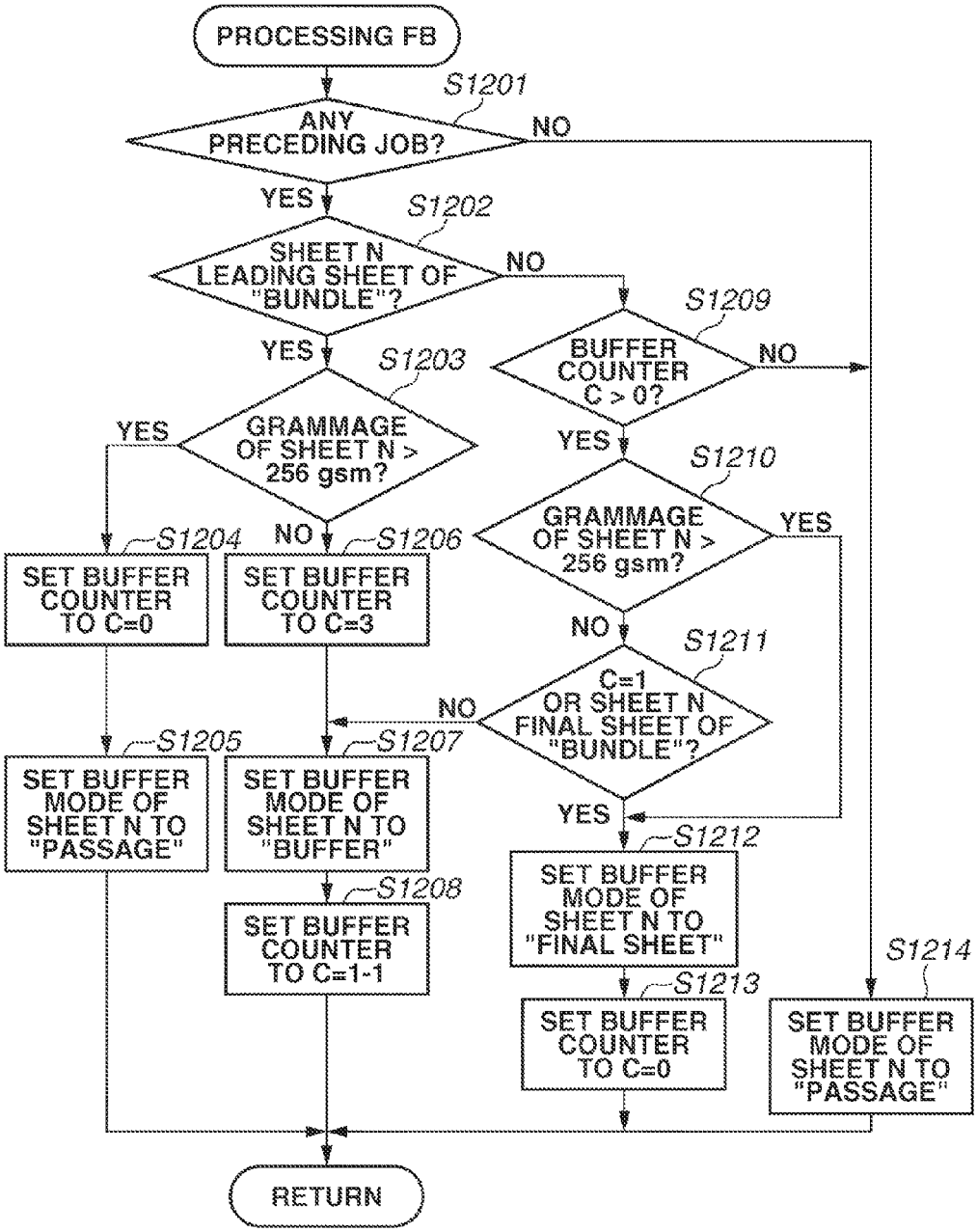
FIG. 15 is a flowchart illustrating buffer mode setting processing in a staple mode.

Next, the sheet flow in the staple mode will be described with reference to FIGS. 3, 7C, 9A to 9C, 11, and 16 and the flowchart in FIG. 15.

Figure 9B:
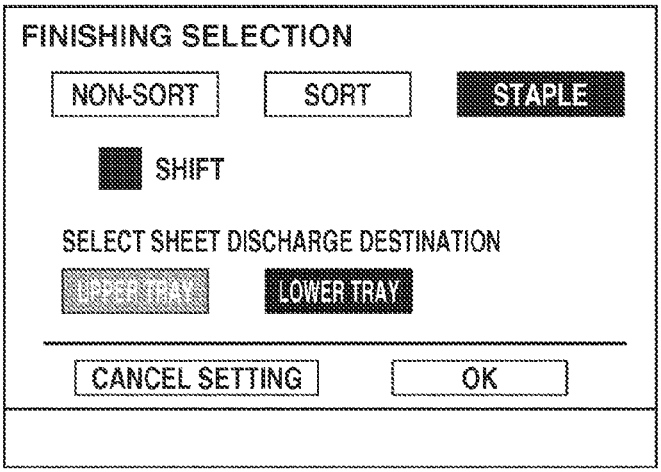
Figure 9C:
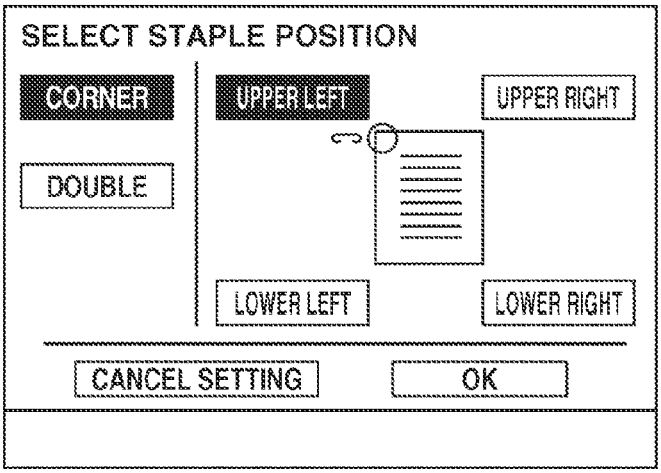

When the "staple" key is pressed on the finishing menu selection screen illustrated in FIG. 9B, a staple setting screen as illustrated in FIG. 9C is displayed on the display unit 420, and the user can select the binding method such as corner stapling and two-position stapling.

In the finisher 500 according to the present exemplary embodiment, the staple processing is performed on the sheets stacked on the processing tray 630. Thus, in the case where the "staple" key is selected on the finishing menu selection screen illustrated in FIG. 9B, the stacking tray 701 ("upper tray") is grayed out so that it cannot be selected as the discharge destination.

When the staple mode is set by the user and a job is input, the CPU 901 in the CPU circuit unit 900 previously informs the CPU 952 in the finisher control unit 951 of information related to the job for each sheet. The information related to the job includes a size, a grammage, a sheet shifting direction, a sheet discharge destination, staple designation information, and the like.

First, the CPU 952 moves the stapler 601 to a staple position and a position according to the sheet size by the stapler movement motor M18. Then, the CPU 952 conveys the sheet to the lower conveyance path 522 as in the case of discharging the sheet onto the stacking tray 700 in the shift sort mode. In the shift sort mode, the sheet is discharged onto the stacking tray 700 without being stacked on the processing tray 630, whereas, in the staple mode, the sheet is discharged onto the processing tray 630 as illustrated in FIG. 7C.

The processing FB, which is executed when the staple mode is set for the sheet N in the above-described flowchart in FIG. 11, will be described with reference to FIG. 15.

In step S1201, the CPU 952 determines whether there is a sheet of the preceding print job on the processing tray 630 or whether there is a sheet of the preceding set of copy thereon. When there is no sheet on the processing tray 630 (NO in step S1201), in step S1214, the CPU 952 sets the buffer mode of the sheet N to "passage."

Although not described in the processing FB, each time a sheet is discharged onto the processing tray 630, an alignment operation is performed by the alignment member 641. Further, when all the sheets constituting a booklet are stacked on the processing tray 630, after the completion of the alignment operation on the finally stacked sheet, the staple motor M17 is driven, and the stapler 601 binds the sheet bundle. After the completion of the binding operation by the stapler 601, the rocking motor M19 is driven to lower a bundle discharge roller 680*a*, so that the bundle discharge roller pair 680 pinches and discharges the sheet bundle P onto the stacking tray 700.

On the other hand, in step S1201, if a sheet of the preceding job or a sheet of the preceding set of copy is stacked on the processing tray (YES in step S1201), in step S1202, the CPU 952 determines whether the sheet N is the first sheet of the set of copy.

If the sheet N is the first sheet (YES in step S1202), then in step S1203, the CPU 952 determines whether the grammage of the sheet N is more than 256 gsm. When the grammage of the sheet N is more than 256 gsm (YES in step S1203), in step S1204, the CPU 952 assigns zero to a buffer counter C prepared on the RAM 954, and in step S1205, sets the buffer mode of the sheet N to "passage."

The buffer counter C indicates the number of sheets on which buffering is performed. In the case of thick paper, the buffer counter C is set to zero, so that no buffering is performed. When no buffering is performed, the CPU 952 previously instructs the CPU 901 of the image forming apparatus 10 to enlarge the sheet interval between the sheet N and the immediately preceding sheet.

In step S1203, if the grammage of the sheet N is not more than 256 gsm (NO in step S1203), in step S1206, the CPU 952 assigns three to the buffer counter C. More specifically, when the sheets are not the thick paper, there is performed buffering on three sheets at the most.

Then, in step S1207, the CPU 952 sets the buffer mode of the sheet N to "buffer," and, in step S1208, decrements the buffer counter C.

When, in step S1202, the sheet N is not the first sheet of the set of copy (NO in step S1202), in step S1209, the CPU 952 determines whether the value of the buffer counter C is more than zero. When the value of the buffer counter C is zero (NO in step S1209), the processing proceeds to step S1214.

When the value of the buffer counter C is larger than zero (YES in step S1209), in step S1210, the CPU 952 determines whether the grammage of the sheet N is more than 256 gsm. When the grammage of the sheet N is not more than 256 gsm (NO in step S1210), in step S1211, the CPU 952 determines whether the value of the buffer counter C is one or whether the sheet N is the final sheet of the set of copy.

When the buffer counter C indicates one or the sheet N is the final sheet of the set of copy (YES in step S1211), in step S1212, the CPU 952 sets the buffer mode of the sheet N to "final sheet", and in step S1213, assigns zero to the buffer counter C.

In step S1211, if the buffer counter C does not indicate one and the sheet N is not the final sheet of the set of copy (NO in step S1211), in step S1207, the CPU 952 set the buffer mode of the sheet N to "final mode."

When, in step S1210, the grammage of the sheet N is more than 256 gsm (YES in step S1210), in step S1212, the CPU 952 sets the buffer mode of the sheet N to "final sheet." In other words, the thick paper is discharged onto the processing tray 630 without being retained in the buffer path 523.

Patterns 4 and 5 in FIG. 16 illustrate the discharge pattern of sheets for which the staple mode is set. The sheets illustrated in patterns 4 and 5 are those from the second copy onward.

In pattern 4, the first through fourth sheets are plain paper. The first through third sheets undergo buffering, and the three sheets are discharged onto the processing tray while overlapped one upon the other. The operation in this case will be described with reference to the flowchart in FIG. 15.

For the first sheet, the processing is performed in the order of steps S1201, S1202, S1206, S1207, and S1208. For the second sheet, the processing is performed in the order of steps S1201, S1202, S1209, S1210, S1211, S1207, and S1208. For the third sheet, the processing is performed in the order of steps S1201, S1202, S1209, S1210, S1211, S1212, and S1213. For the fourth sheet, the processing is performed in the order of steps S1201, S1202, S1209, and S1214.

In pattern 5, the first through fourth sheets are thick paper. Accordingly, none of the sheets undergo buffering. In this case, the interval between the sheets discharged from the image forming apparatus is controlled so as to be wider than usual.

As described above, sheets whose grammage is less than a predetermined value are discharged onto the stacking tray, with a plurality of them being overlapped one upon the other at one time, so that the sheet dropping speed is not lower than that in the case where the sheets are discharged one by one. Accordingly, it is possible to perform a satisfactory alignment operation on sheets whose grammage is less than a predetermined value as in the case where the sheet grammage is not less than the predetermined value.

While the present disclosure has been described with reference to exemplary embodiments, it is to be understood that the invention is not limited to the disclosed exemplary embodiments. The scope of the following claims is to be accorded the broadest interpretation to encompass all modifications, equivalent structures, and functions.

What is claimed is:

1. A sheet stacking apparatus comprising:

a determination unit configured to determine a type of a sheet;

an overlapping unit configured to overlap a sheet to be conveyed with a following sheet and convey the overlapped sheets;

a stacking tray onto which a sheet bundle conveyed as overlapped sheets by the overlapping unit, or a sheet conveyed without being overlapped with a following sheet by the overlapping unit, is discharged, and moves up and down according to the stacked amount of the discharged sheets;

an alignment unit configured to align sheets stacked on the stacking tray; and a control unit configured to discharge the sheet onto the stacking tray by overlapping with a following sheet by the overlapping unit if the sheet which is determined by the determination unit is a first type sheet, and discharge the sheet onto the stacking tray without overlapping with the following sheet by the overlapping unit if the sheet which is determined by the determination unit is a second type sheet, wherein the first type sheet is lighter than the second type sheet.

2. The sheet stacking apparatus according to claim 1, wherein in a case where the type of Nth sheet which is determined by the determination unit is the first type and the Nth sheet is a final sheet of one set copy, the control unit controls the overlapping unit so that the Nth sheet and a preceding N−1th sheet to be overlapped.

3. The sheet stacking apparatus according to claim 1, wherein even if the type of the Nth sheet determined by the determination unit is not the first type, the control unit controls the overlapping unit so that the Nth sheet and a N+1th sheet to be overlapped in a case when the N+1th sheet which is determined by the determination unit is the first type and is a final sheet of one set copy.

4. The sheet stacking apparatus according to claim 1, further comprising a sheet detection unit configured to detect a trailing edge of a sheet, or a trailing edge of a sheet bundle, on an upstream side of the stacking tray in a conveyance direction of the sheet, wherein, regardless of the type of the sheet which is determined by the determination unit is the first type or the second type, the alignment unit begins an alignment operation when a predetermined period of time has elapsed after the detection of the trailing edge of the sheet or the trailing edge of the sheet bundle by the sheet detection unit.

5. The sheet stacking apparatus according to claim 1, wherein the determination unit determines the type of a sheet according to sheet information received from an image forming apparatus which is connected in upper stream than the sheet stacking apparatus in a sheet conveyance direction.

6. The sheet stacking apparatus according to claim 1, wherein the determination unit determines a sheet whose grammage is less than a predetermined value as the first type sheet.

7. The sheet stacking apparatus according to claim 1, further comprising a binding unit configured to perform binding processing on a sheet bundle including a plurality of sheets and to discharge the sheet bundle on which the binding processing is executed, to the stacking tray, wherein, in a case where execution of binding processing on the sheet to be conveyed is designated and a sheet bundle, which is different from the sheet bundle to be subjected to binding processing together with the sheet, does not exist in the binding unit, the control unit causes the sheet to be conveyed without overlapping with a subsequent sheet by the overlapping unit, regardless of the type of the sheet which is determined by the determination unit.

8. An image forming apparatus comprising:

an image forming unit configured to form an image on a sheet;

a determination unit configured to determine a type of a sheet;

an overlapping unit configured to overlap a sheet to be conveyed with a following sheet and convey the overlapped sheets;

a stacking tray onto which a sheet bundle conveyed as overlapped sheets by the overlapping unit, or a sheet conveyed without being overlapped with a following sheet by the overlapping unit, is discharged, and moves up and down according to the stacked amount of the discharged sheets;

an alignment unit configured to align sheets stacked on the stacking tray; and a control unit configured to discharge the sheet onto the stacking tray by overlapping with a following sheet by the overlapping unit if the sheet which is determined by the determination unit is a first type sheet, and discharge the sheet onto the stacking tray without overlapping with the following sheet by the overlapping unit if the sheet which is determined by the determination unit is a second type sheet, wherein the first type sheet is lighter than the second type sheet.

9. The image forming apparatus according to claim 8, wherein in a case where the type of a Nth sheet which is determined by the determination unit is the first type and the Nth sheet is a final sheet of one set copy, the control unit controls the overlapping unit so that the Nth sheet and a preceding N−1th sheet to be overlapped.

10. The image forming apparatus according to claim 8, wherein even if the type of the Nth sheet determined by the determination unit is not the first type, the control unit controls the overlapping unit so that the Nth sheet and the N+1th sheet to be overlapped in a case when the N+1th sheet which is determined by the determination unit is the first type and is a final sheet of one set copy.

11. The image forming apparatus according to claim 8, further comprising a sheet detection unit configured to detect a trailing edge of a sheet, or a trailing edge of a sheet bundle, on an upstream side of the stacking tray in a conveyance direction of the sheet, wherein, regardless of the type of the sheet which is determined by the determination unit is the first type or the second type, the alignment unit begins an alignment operation when a predetermined period of time has elapsed after the detection of the trailing edge of the sheet or the trailing edge of the sheet bundle by the sheet detection unit.

12. The image forming apparatus according to claim 8, wherein the determination unit determines a sheet whose grammage is less than a predetermined value as the first type sheet.

13. A sheet stacking apparatus comprising:

an overlapping unit configured to overlap a sheet conveyed with another sheet and convey the overlapped sheets;

a stacking tray onto which a sheet bundle conveyed as overlapped sheets by the overlapping unit, or a sheet conveyed without being overlapped with another sheet by the overlapping unit, is discharged, and moves up and down according to the stacked amount of the discharged sheets;

an alignment unit configured to align sheets stacked on the stacking tray; and a control unit configured to discharge the first type sheet onto the stacking tray by overlapping with another sheet by the overlapping unit, and discharge the second type sheet onto the stacking tray without overlapping with another second type sheet by the overlapping unit, wherein the first type sheet is lighter than the second type sheet.

14. The sheet stacking apparatus according to claim 13, further comprising a sheet detection unit configured to detect a trailing edge of a sheet, or a trailing edge of a sheet bundle, on an upstream side of the stacking tray in a conveyance direction of the sheet, wherein, regardless of whether the type of the sheet is the first type or the second type, the alignment unit begins an alignment operation when a predetermined period of time has elapsed after the detection of the trailing edge of the sheet or the trailing edge of the sheet bundle by the sheet detection unit.

15. The sheet stacking apparatus according to claim 13, wherein the alignment unit executes an alignment process every time when a sheet bundle and any one of the sheet is stacked onto the stacking tray.

* * * * *